US005276430A

United States Patent [19]

Granovsky

[11] Patent Number: 5,276,430

[45] Date of Patent: Jan. 4, 1994

[54] METHOD AND ELECTROMAGNETIC SECURITY SYSTEM FOR DETECTION OF PROTECTED OBJECTS IN A SURVEILLANCE ZONE

[76] Inventor: Moisei S. Granovsky, 51 Threadneedle Cr., Willowdale, Ontario, M2H 1Z7, Canada

[21] Appl. No.: 871,680

[22] Filed: Apr. 21, 1992

[30] Foreign Application Priority Data

Mar. 17, 1992 [EP] European Pat. Off. ..... 92200765.3

[51] Int. Cl.[5] ..... G08B 13/14

[52] U.S. Cl. ..... 340/572; 340/505; 340/825.54

[58] Field of Search ..... 340/572, 551, 505, 825.54, 340/825.57, 825.2, 825.14, 309.15

[56] References Cited

U.S. PATENT DOCUMENTS

| | | | |
|---|---|---|---|
| 3,990,065 | 11/1976 | Purinton et al. | 340/572 |
| 4,300,183 | 11/1981 | Richardson | 340/572 X |
| 4,429,302 | 1/1984 | Vandebutt | 340/572 |
| 4,527,152 | 7/1985 | Scarr et al. | 340/572 |
| 4,623,877 | 11/1986 | Buckens | 340/572 |
| 4,663,612 | 5/1987 | Mejia et al. | 340/572 |
| 4,686,154 | 8/1987 | Mejia | 340/572 X |

*Primary Examiner*—John K. Peng
*Assistant Examiner*—Thomas J. Mullen, Jr.
*Attorney, Agent, or Firm*—Rogers & Scott

[57] ABSTRACT

The transmitter antenna coils (3,4) provide an oscillatory electromagnetic field in a surveillance zone (1) wherein a security tag of easily saturable magnetic material originates a tag signal. The original tag signal detected by the receiver antenna coils (6,7) is modified to obtain predetermined characteristics of an AC-pulse. The modified tag signals are further processed in a signal processor (18) by methods of synchronous detection and synchronous accumulation which not only increase a signal to noise ratio but also provide rejection of external periodic noises. The controller (14) provides a time-domain blanking for the cyclic operation of the system. The interrogation field is periodically made weaker, which allows to separate true tag signals from those originated by other magnetizable objects. The noise level is also determined periodically during time intervals in which no tag signal can possibly exist. This noise level is used as a dynamic reference which effectively prevents false alarms. If at the end of every surveillance cycle predetermined conditions are met a decision regarding an alarm is made.

46 Claims, 13 Drawing Sheets

METHOD AND ELECTROMAGNETIC SECURITY SYSTEM FOR DETECTION OF PROTECTED OBJECTS IN A SURVEILLANCE ZONE

FIELD OF INVENTION

This invention relates to the detection of the presence of protected objects in a surveillance zone and more particularly to the method and apparatus for the reliable detection of a security tag made of soft magnetic material (with a very narrow hysteresis loop) and attached to the object, the unauthorized removal of which through an oscillatory electromagnetic field within the surveillance zone has to be prevented.

BACKGROUND OF THE INVENTION

In 1934 French Patent No. 763,681 was issued to P. A. Picard. In this patent a security system detecting the distortion of an interrogation electromagnetic field by a security tag comprizing soft magnetic material (of permalloy type) was disclosed. That was the start of a new class of inventions.

Since then, for almost half a century, a great multiplicity of methods and systems related to this class has been invented and the number of such inventions is steadily growing, evidencing that the need in a truly satisfactorily performing system is still there, simply because such a system has not been invented yet.

Most of the electromagnetic security systems use the frequency-domain approach to signal processing, looking for such predetermined features of a tag signal as a certain ratio of certain harmonics (e.g. U.S. Pat. No. 4,535,323) or a phase shift of harmonics (e.g. U.S. Pat. No. 4,791,412). There are many inventions related to this approach disclosing specially synthesized magnetic materials with uniquely shaped hysteresis loops (e.g. U.S. Pat. No. 4,823,113) or uniquely constructed so called "coded" tags (e.g. U.S. Pat. No. 4,799,076). Nevertheless, these costly solutions do not provide satisfactory separation of a true tag signal from that produced by other magnetizable metal objects (e.g. shopping carts) simply because the field in the surveillance zone is not uniform and is also biased by the earth magnetic field. This often results in the tag signals and also the spurious signals from metal objects having frequency contents different from those attributed to them. This will cause either a failure to recognize the real tag or a false alarm. Periodic external noises (for example from video monitors) can also produce stable frequencies within bands open for expected tag signal frequencies.

The "frequency-domain" systems have to use a continuous transmission of the interrogation field in order to obtain sensible magnitudes of the harmonics of a tag signal. But it is possible to utilize a continuous transmission in so called "time domain" systems which are concerned with the shape of a signal rather than with the frequency content of same. U.S. Pat. No. 4,623,877 describes such a "time-domain" system with continuous transmission. This invention uses a bias provided by the earth magnetic field to the interrogation field which results in an asymmetry in the positions of tag signals with regard to periodically repeated certain points of the interrogation field. This invention claims that any other magnetic but not so easily saturated material can produce field disturbance signals at the points where the field is much stronger and therefore those signals will be more symmetric. In addition, this invention also provides periodic blanking of the signal processor at the time intervals corresponding to the amplitude levels of the field in order to ignore signals from metal objects originated in a strong field. But when placed close to one of the transmitting antennae, where the strength of the field is really high and the biasing effect of the earth magnetic field is almost negligible, the tag signals will have a good symmetry and may be ignored, whereas the metal objects will be saturated at much lower than amplitude levels of the alternating field, thus producing asymmetric signals within the time windows and therefore initiating a false alarm. The earth magnetic field is also very weak in the areas close to the equator, so this system will not be efficient if installed in many countries of Latin America or Africa or even the Middle East. As well, a periodic external noise asynchronous to the interrogation field (from video monitors, for example) can produce a sensible level of asymmetry and cause a false alarm unless long averaging is used, which makes the system slow.

The continuous way of transmission when used in conjunction with a "flat" transmitting antenna is not effective for adequate spatial distribution of the field and therefore many such systems either use antennae of complicated and cumbersome construction or just use flat antennae, sacrificing performance by accepting large dead sections within the surveillance zone.

There are only a few systems of the prior art utilizing a pulsing concept of transmission when every transmission pulse consists of several numbers of periods and there is a pause between pulses. In U.S. Pat. Nos. 4,300,183 and 4,527,152 the pulsing concept is used to change alternatively from zero to 180° and vice versa the phase difference between currents in two transmitting flat coils creating together an interrogation field. This provides better coverage of the protected space when flat transmitting antennae are utilized. No other use of the pulsing transmission was disclosed in the prior art inventions, although this type of transmission, unlike the continuous one, can offer very satisfactory solutions to the false alarm problems.

The prior art systems with pulsing transmission are related to the time-domain group. For signal recognition, these systems use either a comparison of the wave shape of the distortion signal to stored samples of possible wave shapes (as was disclosed in U.S. Pat. No. 4,663,612), or (as was proposed in U.S. Pat. No. 4,527,152) decide about the presence of a tag signal by measuring the width of a pulse in the time-window, or by the use of cross correlation between a stored signal and a repeated one in order to establish how similar they are. All these methods provide neither adequate reliability of signal recognition nor protection against false alarms. It is practically very difficult to obtain a pure tag signal without altering its characteristics, considering the inevitable use of filters to suppress the main frequency of the field and its harmonics in the receiver circuitry, components of which have band limitations of their own (not to mention that in a very wide-banded system the noise level can swallow the signal completely). Therefore, both original tag signals (even if uniquely shaped as was suggested in U.S. Pat. No. 4,686,154) and spikes of noise are reshaped in the receivers, often acquiring shapes which are similar to those stored as the samples they are to be compared with. The method of pulse width measurement can cause severe false alarming in a noisy environment, and cross-correlation methods are totally helpless against a succession of identical spurious signals originated either by metal objects in the interrogation field or induced by external periodic fields from, for example, horizontal deflection units of video monitors.

BRIEF SUMMARY OF THE INVENTION

It is the object of the present invention to overcome disadvantages of the prior art and to provide the method and apparatus for reliable detection of a magnetic security tag within a protected zone surveyed by an oscillatory electromagnetic field.

The invention provides the method and means to modify and standardize differently shaped original tag signals so that synchronous detection methods can be used for reliable recovery of a modified tag signal from noise.

Another method, using a predetermined reduction of the field strength at certain moments of the transmission, and the means suitable for this method are provided for the reliable separation of true signals from those originated by metal objects.

Another aspect of the invention provides the method and means to suppress a periodic external noise with a known repetition rate within the time windows.

Yet another aspect of the invention provides a method, utilizing a choice of moment(s) to start a certain pulse(s) of transmission in order to reject periodic noises with unknown frequencies and the suitable means for the embodiment of this method are provided.

The invention also provides the method and means for a cyclic evaluation of an external noise during time periods in which no tag signal can possibly exist, for example, during a pause following the termination of a transmission pulse.

The noise evaluation is used in the present invention as a dynamic threshold, which effectively prevents false alarms due to any noise unrelated to the interrogation field.

Another aspect of the invention provides a method and the means for cyclic redistribution of the spatial orientation of the field. According to the method, during some of the surveillance cycles both transmitting antennae transmit their oscillatory fields simultaneously and in phase opposition, whereas during some other cycles only one second of these antennae transmits.

BRIEF DESCRIPTION OF THE DRAWINGS

The detailed description of the invention will be given below with reference to the accompanying drawings of an example of an embodiment of the invention.

DETAILED DESCRIPTION OF THE INVENTION

Figure 1:
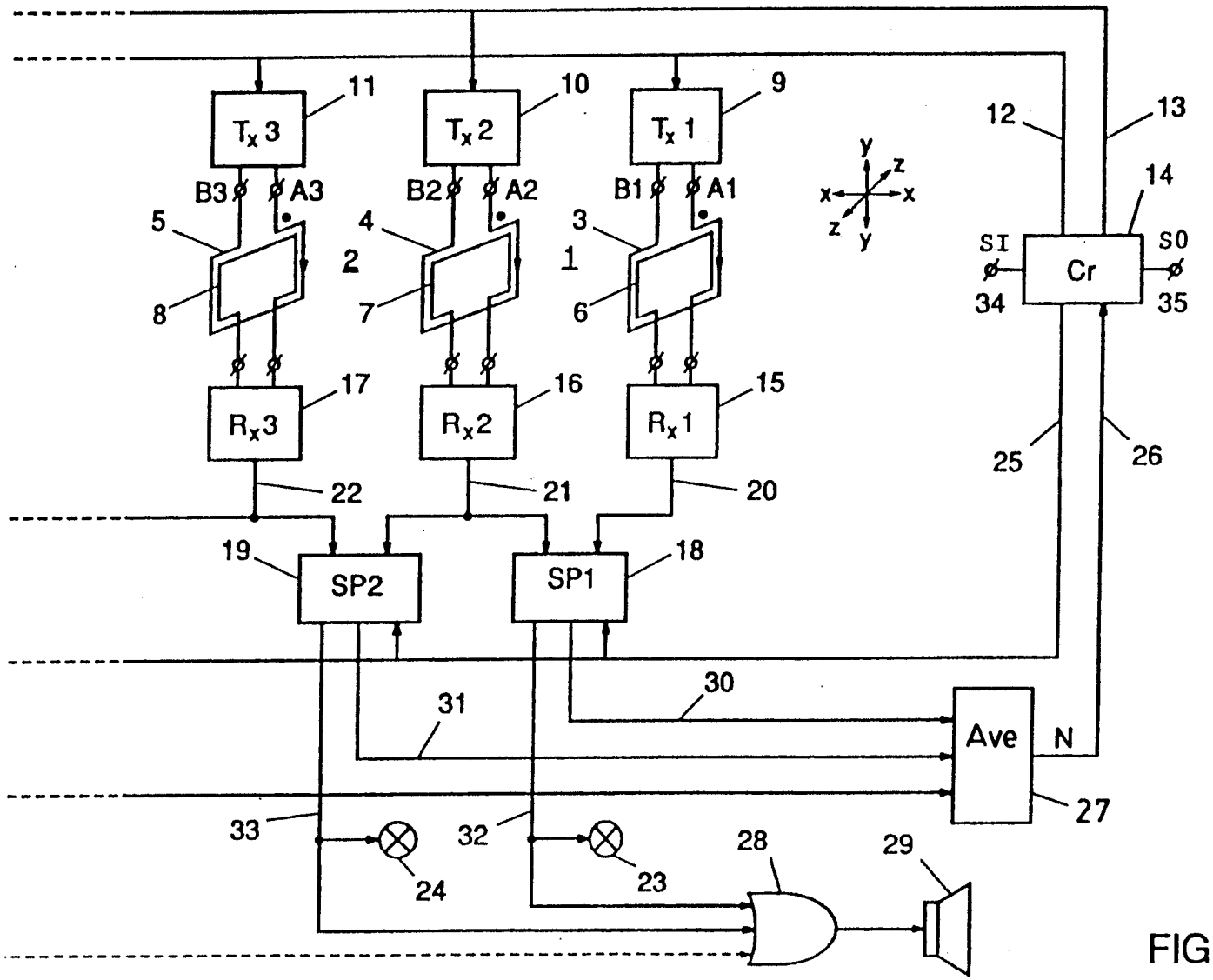
FIG. 1 is a block diagram of the preferred embodiment of a security system according to the present invention.

FIG. 1 shows the block diagram of the preferred embodiment of a security system according to the present invention. As shown here, the system comprises two gates (or passageways) 1 and 2 which illustrates the possible way to expand the system. However a system with only one security gate is fully representative of the present invention. Therefore, the system, where possible, will be described as, containing only one gate (1 for example). This gate is defined by two identical panels comprising at least one pair of transmitting antennae (3 and 4) and a corresponding pair of receiving antennae (6 and 7). The transmitting antennae (3 and 4) are connected to the terminals $A_1$,$B_1$ and $A_2$,$B_2$ of the transmitters $Tx_1$ (9) and $Tx_2$ (10) respectively. These transmitters are operated in accordance with commands 12 and 13 from the controller Cr (14) and use their antennae (3 and 4) to produce an interrogation electromagnetic field H alternating with frequency $f_o$ in the surveillance zone (1). This field is able to drive the soft (i.e. having narrow hysteresis) loop magnetic material, of which the security tag is made, alternatively from one magnetically saturated state to another. Such an excourse along the hysteresis loop from, for example, a positive saturation level of inductance (+Bmax) to a negative one (−Bmax), or vice versa, will produce in the receiving antennae (6 and 7) an original tag signal proportional, as is well known, to $$\frac{dB}{dt} = \frac{dB}{dH} \cdot \frac{dH}{dt},$$

where db/dh is a property of the magnetic material of the tag, and dh/dt is the rate of change of an interrogation field in the spot where the tag is present. It is obvious that the narrower the hysteresis (or the softer the material of the tag), the weaker the interrogation field that will be needed in order to generate the tag signal, and that the greater the squareness db/dh of the hysteresis, the larger the magnitude of the tag signal will be.

As will be seen later, according to the present invention the system is able to work successfully with any soft magnetic material, once the following two conditions are met: the tag material should have a rather narrow and fairly square hysteresis.

The outputs of the receiving antennae (6, 7) are connected to the inputs of the receivers $R_{x1}$ (15) and $R_{x2}$ (16) respectively. The receivers are identical, each of them comprises a preamplifier and a set of filters which removes the harmonies of the interrogation field and modifies the recovered tag signal to given specifications, which will be discussed later on.

The outputs (20, 21) of the receivers (15, 16) are connected to the respective inputs of the signal processor SP1 (18). The antennae (6, 7) receive not only the tag signal, when present, but also signals from various other sources which constitute noise for the system.

The general goal of the signal processor (18) is to recover the tag signal from the noise. If the tag signal is present the signal processor will create an alarm, which can be expressed in a visual form using a lamp (23) and/or in an audio form using some kind of an audio alarm device (29). The set of various commands (25) needed to control the signal processor (18) is originated by the controller Cr (14).

As will be disclosed later on, the controller (14), among other functions, searches for the best possible regime to control the transmitters in order to drastically reduce noise caused by external sources such as different video monitors. For this purpose feedback (26) is employed, supplying the controller (14) with information about the current noise level N in the signal processor (18) at every stage of the search.

The noise level (30) from the signal processor (18) enters the controller as a signal N via an averager (27), used for the purpose which will be disclosed hereafter.

Up to this point the block-diagram of the single gate system has been described. The extension of the system in order to create an additional gate (e.g. gate 2 in FIG. 1) can be achieved by installing an additional panel containing transmitting and receiving antennae (5 and 8), and by adding additional transmitter $T_{x3}$ (11), receiver $R_{x3}$ (17), signal processor SP2 (19) and alarm producing means (24).

There are many logistic approaches to how the alarm in a multigate system can be organized. The structure of each gate having a dedicated signal processor can use either individual alarms for each protected passageway, or bring together all the alarm signals (32, 33 . . . ) from all signal processors using a logic OR-gate (28). Such a structure also allows the use of various possible combinations of these above mentioned approaches.

In the preferred embodiment, as shown in FIG. 1, a common audio alarm device 29 (e.g. a siren), which is activated via logic OR-gate (28) by any one of the individual signals (32, 33), is used. The sound of the audio device (29) means that there is a trouble at the gates, but the audio alarm is unable to indicate through which gate the attempt to smuggle a protected object has been made. This can be an especially difficult situation when traffic through the gates is dense. That is why in the system, as shown in FIG. 1, individual visual alarm devices (e.g. blinking lamps 23, 24) are employed.

In a multigate system every panel, containing a set of transmitting and receiving antennae, is common for both gates adjacent to it. For example, the panel containing antennae 4 and 7 is common for both gates 1 and 2. Therefore, the output signal (21) of the receiver $R_{x2}$ (16) should be applied to inputs of both signal processors SP1 (18) and SP2 (19), and the signal (22) from the output of the receiver $R_{x3}$ (17) would be entering both signal processors SP2 and SP3 (not shown) if an additional gate 3 (not shown) were used in the system, and so on.

Regarding transmitters, it must be noted that since every one of them (with the exception of the very first and last ones) together with both neighbouring transmitters (e.g. $T_{x2}$ with its neighbours $T_{x1}$ and $T_{x3}$) is participating in simultaneous surveillance of both (on both sides of the panel) zones 1 and 2, then both these neighbouring transmitters $T_{x1}$ and $T_{x3}$must be acting exactly in the same manner. Being identical, these transmitters must be controlled by the same set of commands (12) from the controller (14). That means that in a multigate system all odd numbered transmitters ($T_{x1}$, $T_{x3}$, etc) are connected to the controller (14) via a common control line (12), whereas all even numbered transmitters ($T_{x2}$, $T_{x4}$, etc.) are getting commands from the controller (14) using another common control line (13).

In the multigate system of the present invention all signal-processors are identical and are controlled by the same set of commands (25) from the controller (14).

In case of a multigate system, a plurality of noise levels (30, 31 . . . ) will be sent to the controller (14) from the plurality of signal processors SP1, SP2 etc. These noise levels, even if originated by the same source of noise, in general are not equal due to the fact that the receiving antennae of each gate are positioned differently with respect to the source of noise. That is why in the preferred embodiment of this invention an averager (27) is used, producing an average N of noise levels (30, 31 . . . ). This averaged signal (26) represents the noise level N in the multigate system for the controller.

Although the controller (14), according to the present invention, can, in principle, accommodate a system with any degree of complexity, in practice there is a limitation to the number of gates that can be accommodated by the same controller Cr. This limit is based upon various practical considerations such as, for example, the size of the power supply, which depends upon the power consumption of the system, the number of printed circuit boards, the size of the chassys containing these boards and power supplies, the complexity of the cabling and so on.

In some cases several systems can be installed within "cross-talking" distances, meaning that the activity of some of them will create a disturbance for the others. In that case, the systems have to be synchronized. The synchronization of the plurality of the systems, according to the preferred embodiment, is executed by the use of synchronizing links among their controllers. Despite the fact that all controllers are identical and are using identical crystal clocks, their surveillance cycles (which will be described hereafter), if not synchronized, are phase-shifted unless some pilot commands are applied simultaneously to all controllers in order to start every surveillance cycle at the same moment. For this purpose every controller (e.g. 14 in FIG. 1) has synchro-input SI and synchro-output SO. In the preferred embodiment of the present invention the signal (35) appearing at the synchro-output SO is created by the controller (14) in order to start its own surveillance cycles. Therefore the signal (35) is named a "cycling wave". An external cycling wave entering the synchro-input SI of some controller enslaves it, suppressing and substituting its own internal cycling wave, and appears at its synchro-output SO as an external synchronizing signal for some other controller.

Figure 2A:
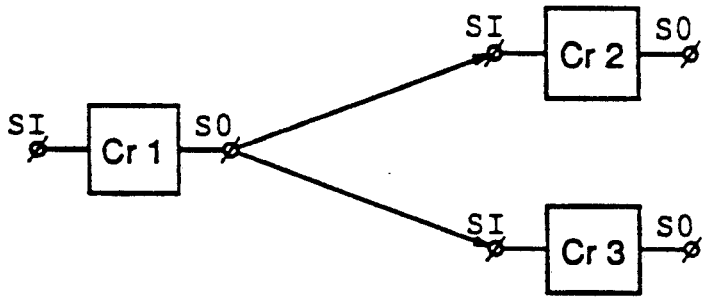
FIGS. 2*a* and 2*b* illustrate two basic "master-slave" configurations for the synchronization of two or more systems.
Figure 2B:
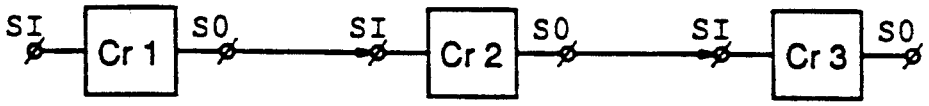

Two basic "master-slave" configurations, radial and in series, are shown in FIG. 2*a* and FIG. 2*b* respectively using as an example three controllers of three separate systems. It is obvious that any other combination using these two structures is possible and the decision as to which one should be used is based upon such practical considerations as the layout of the installation site and the simplicity of wiring.

In the preferred embodiment of the present invention each transmitter $T_x$ is acting in impulse mode, creating in its transmitting antenna an AC-current pulse lasting for several periods of the surveillance field frequency $f_o$. The detailed descriptions of this transmitting pulse and of the transmitter itself will be disclosed hereafter.

Each transmission pulse and the following pause together constitute a transmission period. According to the present invention the security system is working in surveillance cycles, each of which contains a number of transmission pulses. At the end of every surveillance cycle the signal processor (18) makes a decision about whether or not an alarm should be created.

In the preferred embodiment of the present invention each pair of neighbouring transmitters, for instance $T_{x1}$ and $T_{x2}$, is controlled in such a manner that during every second surveillance cycle both corresponding antennae (3, 4) transmit their fields simultaneously and in phase opposition, whereas in between these cycles only one of these two antennae transmits in turn. For example, during the $1^{st}$, $3^{rd}$, $5^{th}$ etc. cycles both antennae transmit in phase opposition, during the $2^{nd}$, $6^{th}$, $10^{th}$ etc. cycles, only one, say, antenna 3 transmits, and during the $4^{th}$, $8^{th}$, $12^{th}$ etc cycles only the second antenna 4 is active.

The advantages of such a method of creating the interrogation field, which is not only pulsing but, in a sense, periodically changing its spatial orientation, can be explained as follows:

By giving up the concept of continuous transmission, it is now possible to examine an external noise during the pauses between transmissions and to use this knowledge (as will be shown later) constructively in order to eliminate or significantly reduce the noise influence on the system. Moreover, a pulsing transmission concept is instrumental for periodic spatial redistribution of the field in the surveillance zone 1. It was found that such a transmission method is very effective for adequate sensing of a tag carried through the gate in various spatial orientations even when flat single-looped transmitting antennae are employed.

The best coupling between the tag and the interrogation field is achieved when the vector of the field is directed along the magnetic strip of the tag. When the tag is coplanar with the transmitting antennae 3 and 4 (being positioned in the YZ-plane in FIG. 1) the lines of the magnetic field to be coupled with the tag are supplied by the current flowing in the sections of the transmitting antennae which are either perpendicular to the tag strip (best case) or at least are able to produce a sufficient vector component in the right angle direction to the tag strip.

As is well known, the field of some segment of a loop is always weaker and decays more rapidly as a function of the distance from this segment than the field of the whole loop itself. This knowledge was behind the decision to have the fields from the transmitting antennae 3 and 4, when transmitting simultaneously, in phase opposition. In this case the corresponding members of both antennae are producing field vectors in the same direction and therefore are doubling the field strength in the middle between these two antennae members. Now when the magnetic strip of the tag is placed within gate 1 along the X-axis, i.e. in orthogonal position with respect to the antennae planes, and if both antennae were still transmitting into the surveillance zone 1 simultaneously and in phase opposition, then the resulting field along the X-axis in the middle section of zone 1 would become zero. This would create a dead zone within passageway 1 for the orthogonal orientation of the tag (along the X-axis).

That is why, after executing the "coplanar" surveillance cycle (with both antennae transmitting in phase opposition), one or the other transmitter will simply not be activated during the cycles when the system is looking for a tag in the orthogonal orientation. This solution is based upon the above mentioned fact that the field $H_x$ generated by the whole loop of each of the antennae 3 or 4 in the X-direction is much greater than the fields $H_y$ or $H_z$ transmitted in the Y or Z directions by any single member of the same antenna. Therefore, if the field strengths $H_y$ and $H_z$ are sufficient in resaturating the tag, then the field $H_x$ will definitely be strong enough to cover at least one half of the gate width on both sides of the transmitting antenna in the X-direction. Thus, during the surveillance cycles when only transmitter $T_{x1}$ is active, the tag oriented orthogonally can be found in that half of the surveillance zone 1 which is adjacent to antenna 3, and during the cycles when only transmitter $T_{x2}$ is active the tag in the orthogonal orientation can be found in the halves of zones 1 and 2 adjacent to antenna 4.

Figure 3:
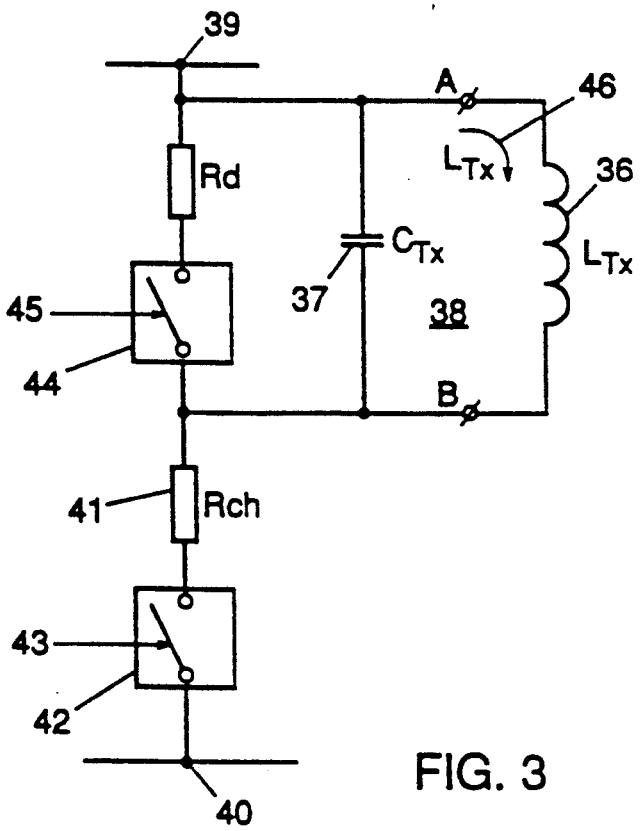
FIG. 3 is a detailed block diagram of the preferred embodiment of a transmitter suitable for use in a system according to the present invention.

The preferred embodiment of a transmitter $T_x$ suitable for use in a system according to the present invention is shown in FIG. 3 in the form of a detailed block diagram. The transmitting antennae coil (36) is connected in parallel to the tuning capacitor (37) via the output terminals A and B of the transmitter, thus forming an LC-tank (38) with resonance frequency $$\omega_o = \frac{1}{\sqrt{L_{Tx} \cdot C_{Tx}}}.$$

This resonance circuit (38) is connected to DC-power supply lines (39, 40) via a resistor (41) and a power switch 42 (HEX-FET, for example) controlled by a signal (43). There is a second resistor $R_d$, which is connected via another power switch (44) in parallel to the tuning capacitor (37). The power switch (44) is controlled by a command (45). Both commands 43 and 45 form a set of commands designated in FIGS. 1 as 12 or 13.

In order not to induce additional internal noise in the system during the time periods in which a tag signal can be expected and which are surrounding zero-crossings of the current (46) in the transmitting antenna (36), the zero-crossings of the current (46) must be clean. None of the power switches available today can be considered as linear elements. That is why the transmitter, as shown in FIG. 3, keeps both power switches 42 and 44 outside the resonance circuit (38).

Figure 4:
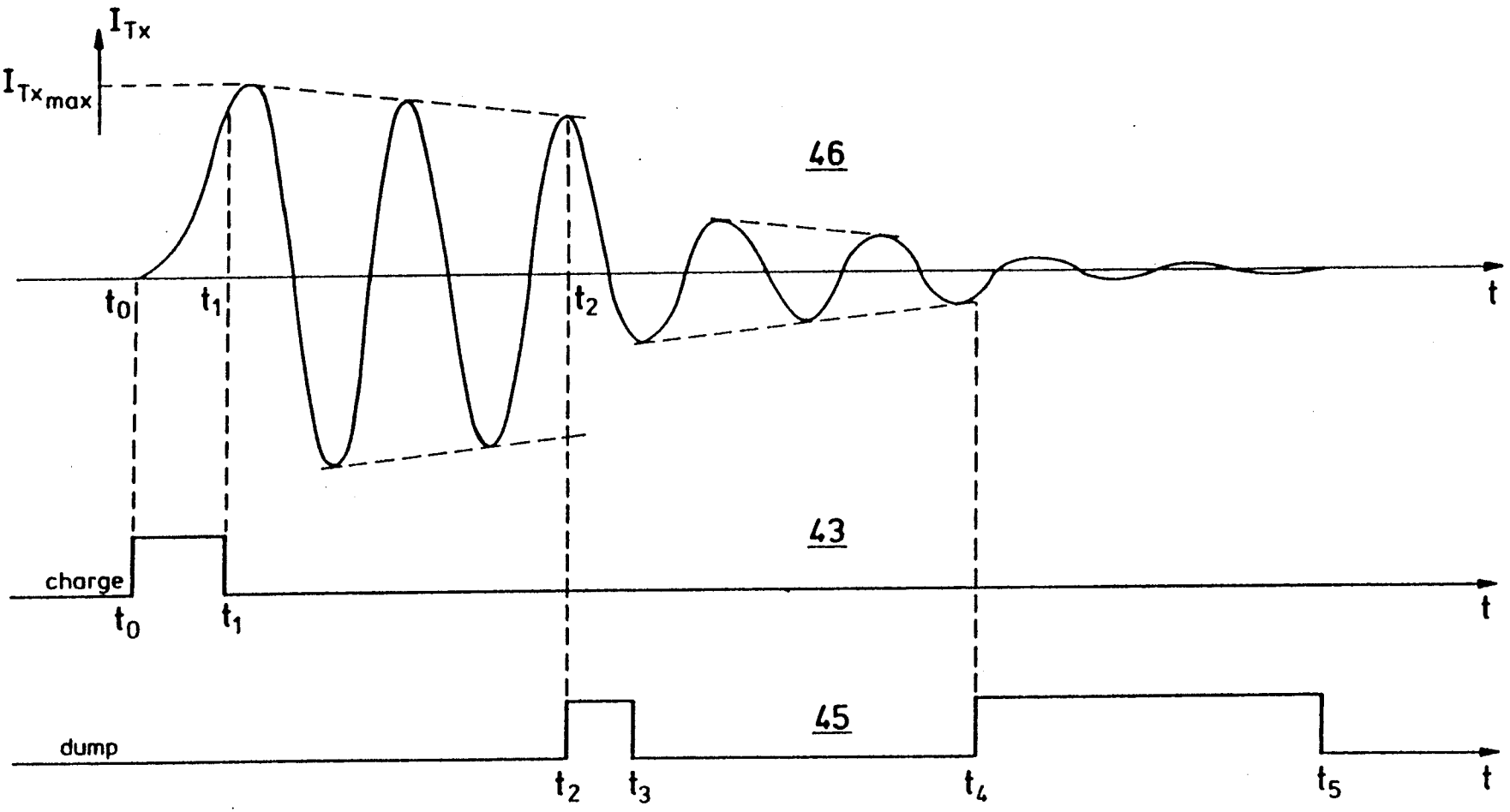
FIG. 4 is a time diagram illustrating signals controlling the transmitter and a current in the transmitting antenna.

The time diagram in FIG. 4 shows the current $I_{Tx}$ (46) in the transmitting antenna loop and signals 43 ("charge") and 45 ("dump") controlling, respectively, the beginning and the energy level of the transmission.

The resonance circuit (38) is being energized when connected for a short time to the power supply via switch 42 and resistor 41, whilst the switch 44 is open.

At certain moment $t_1$ after the termination of signal 43 ("Charge"), switch 42 becomes open and, if switch 44 is still open, the free running oscillations in the resonance tank (38) begin with the initial amplitude of the current $I_{Txmax}$ determined by the duration of the command 43 ("Charge"), as well as by the parameters $L_{Tx}$, $C_{Tx}$, $R_{Ch}$ and, of course, being proportional to the voltage of the power supply. The free-running oscillations initiated in the resonance circuit (38) by pulse 43 ("Charge") decay exponentially, as shown by the dotted lines in FIG. 4. This decay does not affect the performance of the system, according to the present invention, because the transmission pulse is relatively short, containing only a few periods of the resonance frequency $\omega_o$ whereas the Q-factor of the resonance tank (38) in the preferred embodiment is relatively high, being in the order of 50, and, besides, as will be shown later, a decay of the surveillance field is taken into consideration in the signal processing.

When the switch 44 is closed, following the command 45 ("dump"), during the intervals $t_2$-$t_3$ and $t_4$-$t_5$ (FIG. 4) the resonance circuit (38) is getting discharged ("dumped"), dissipating energy on the dumping resistor $R_d$. The degree of the discharge is a function of the duration of command 45. Thus, according to the present invention, any transmitter can be switched on at any predetermined moment $t_o$ and the strength of the transmitting field can be reduced in a controllable manner to various intermediate levels, including zero in a practical sense. A use of all these features, which are important to the preset invention, will be disclosed later on.

As described earlier, during some of the surveillance cycles, any two neighbouring antennae transmit their fields alternating with the same frequency $\omega_o$ simultaneously and in phase opposition. There are several ways to organize the transmission of the two fields in phase opposition. The first way is to have the antennae wound in opposite directions while being connected to respective transmitters identically. The second option uses two identically wound antennae which are connected to the output terminals of respective transmitters in mutually reversed manner. In both these cases all transmitters are switched on at exactly the same moment.

Figure 5:
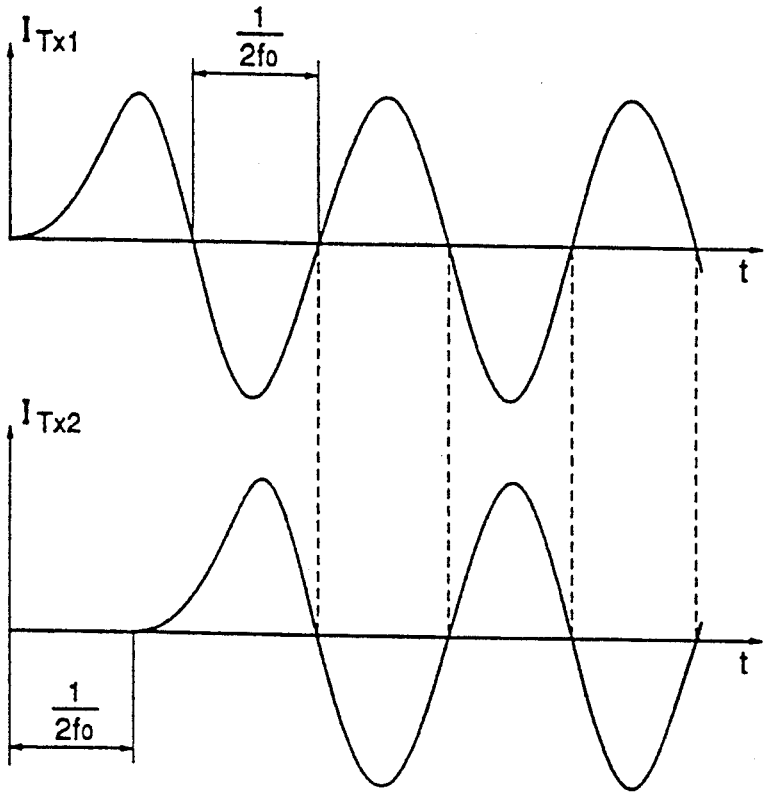
FIG. 5 illustrates a method of energizing two transmitters in such a manner that they transmit their fields in opposite phases.

The preferred embodiment of the present invention utilizes a third option, which unlike the first two does not need either differently wound transmitting antennae or differently assembled gate panels containing both the antennae and the transmitters. This preferred option (see FIG. 1) uses transmitting antennae (3 and 4 for example) identically wound and identically connected to the terminals $A_1$, $B_1$ and $A_2$, $B_2$ of respective transmitters $T_{x1}$ and $T_{x2}$. The start and direction of every transmitting antenna coil winding are indicated in FIG. 1 by dots and arrows. Every two neighbouring transmitters ($T_{x1}$ and $T_{x2}$ for instance) are switched on by respective control signals 12 and 13 at different moments with a time interval which is equal to the duration $$\frac{1}{2f_o}$$

of half a period of the transmitting frequency $f_o$, as illustrated in FIG. 5, where the currents $I_{Tx1}$ and $I_{Tx2}$ of both transmitters $T_{x1}$ and $T_{x2}$ are shown. Thus, any two neighbouring transmitting antennae (e.g. 3 and 4) will emit their electro-magnetic fields in phase opposition.

In most systems both transmitting and receiving antennae are not only sharing the same plane of a gate panel, but the receiving antenna loop closely enough follows the contour of a transmitting antenna loop. Such an arrangement allows an increase in the sensitivity of the system by making sure that a majority of the magnetic lines created by the transmitting antenna loop will intersect with an area encircled by the receiver antenna loop. However, such proximity between both antennae results in a very high level of noise induced into the receiving antenna by the primary field of the transmitting antenna, unless certain measures are undertaken. Twisting a receiver coil loop in a "FIG. 8" manner is one of the commonly used methods to reduce this noise. Another electromechanical method uses an auxiliary coil which is coupled with the transmitting antenna field and connected in opposition to the receiver antenna coil so that the voltage across the auxiliary coil, or a regulated portion of it, will compensate the electromotive force induced into the receiving antenna by the transmitted field.

All such electromechanical methods can be very effective in drastically reducing the transmission noise at the receiver input, but none of them is able to provide adequate balancing for the receiving antenna in order to obtain a clean and stable zero-line necessary to recover the tiny secondary signal (in the range of microvolts) generated by a security tag. That is why the receiver circuitry usually comprises a number of notch-filters tuned to suppress the carrier frequency $f_o$ of a pulse modulated interrogation field as well a number of its odd harmonics: $3f_o$, $5f_o$, and so on (It is known that a periodical function $f(\omega t)$ which is symmetrical around the time axis t i.e. $f(\omega t) = -f(\omega t + \pi)$, does not contain even harmonics).

Figure 6:
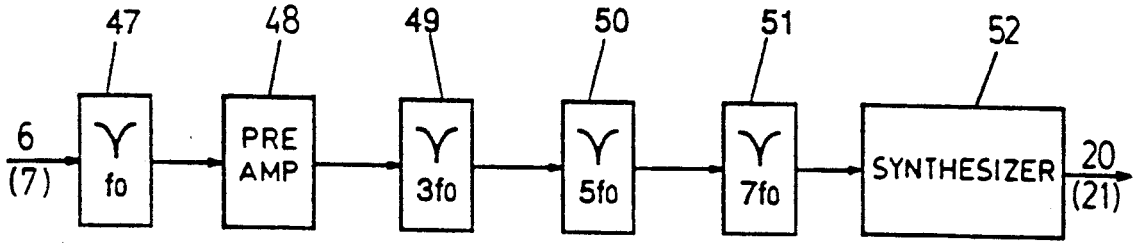
FIG. 6 is a block diagram of the preferred embodiment of the receiver according to the invention.

The block diagram of the preferred embodiment of the receiver $R_x$ is shown in FIG. 6. It comprises four notch filters 47, 49, 50, 51, a preamplifier 48 and a synthesizer 52. The notch filters 47, 49, 50, and 51 are tuned to suppress the first four consecutive odd harmonics $f_o$, $3f_o$, $5f_o$ and $7f_o$ of an interrogation field. These notch filters have a double T-bridge topography each, and they are passive in order not to have a very high Q, considering possible deviation of the frequencies to be notched from their nominal valves and the tolerances of the notch filters components.

The preamplifier 48, being shown as one unit in FIG. 6, consists, in practice, of several stages placed as buffers between and after the passive filters 49, 50, 51. Each of these stages has a gain greater than one. The very first stage uses a very low noise operational amplifier and is purposely placed after the first notch-filter 47 in order not to be saturated by the strong noise originated by the interrogation field in the receiver antenna. In practice, the preamplifier 48 also contains elements of the synthesizer, which for explanatory purposes is shown as a separate block 52 in FIG. 6.

A signal generated by a magnetic tag in the interrogation field hereafter will be called the "original tag signal". It could be seen at the output of the receiving antenna were this signal to be separated from all noises and placed on the ideal zero-line. The original tag signal is a video pulse and is very narrow in comparison with the period of an interrogation field. Therefore, it can be considered as a single impulse, best described by its spectrum rather than by its harmonies content.

A shape, and therefore a frequency spectrum of the original tag signal is a product of two factors: the shape of the hysteresis loop of the magnetic material of the tag, and the rate of change of the electro-magnetic field coupled with the magnetic strip of the tag. Neither of these two factors is constant especially the second one due to a spatial non-uniformity of the interrogation field actually coupled with the tag (which may have any orientation and any position within the gate). That means that the original tag signal can have a wide variety of shapes, and by no means can be considered as fully defined for purposes of signal processing.

Practical shapes of the original tag signal could be symmetrical and resemble the half period of a sine function, or a triangle or a rectangle or the function known as an "elevated sine", and so on. It could also be a non-symmetrical mixture of different functions, for example, the rising edge could be linear whereas the falling one could resemble an exponent with a negative time constant, etc.

Figure 7:
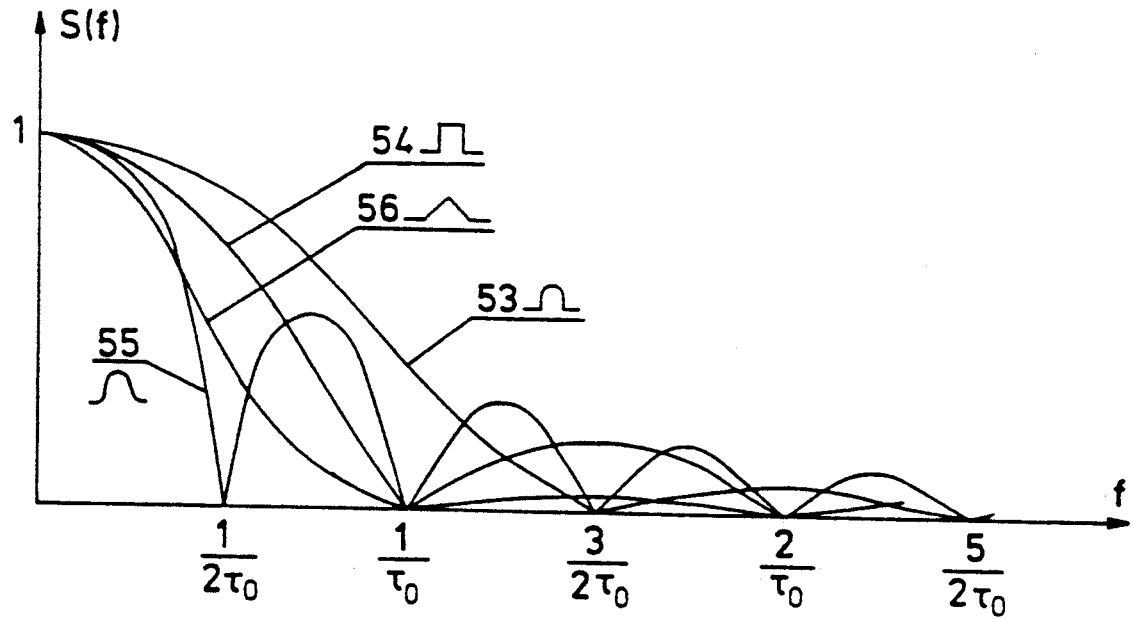
FIG. 7 shows spectra of differently shaped original tag signals.

FIG. 7 shows different original tag signals and their respective spectra S(f). The shapes of the tag signals shown in FIG. 7 are a sine (53), a rectangle (54), an elevated sine (55) and a triangle (56). All of them have an amplitude A and a duration $\tau_o$ (which, for signals (55) and (56), is measured at the half-amplitude level). Spectra S(f) in FIG. 7 have been normalized with respect to the values of the product $A\tau_o$.

Figure 8:
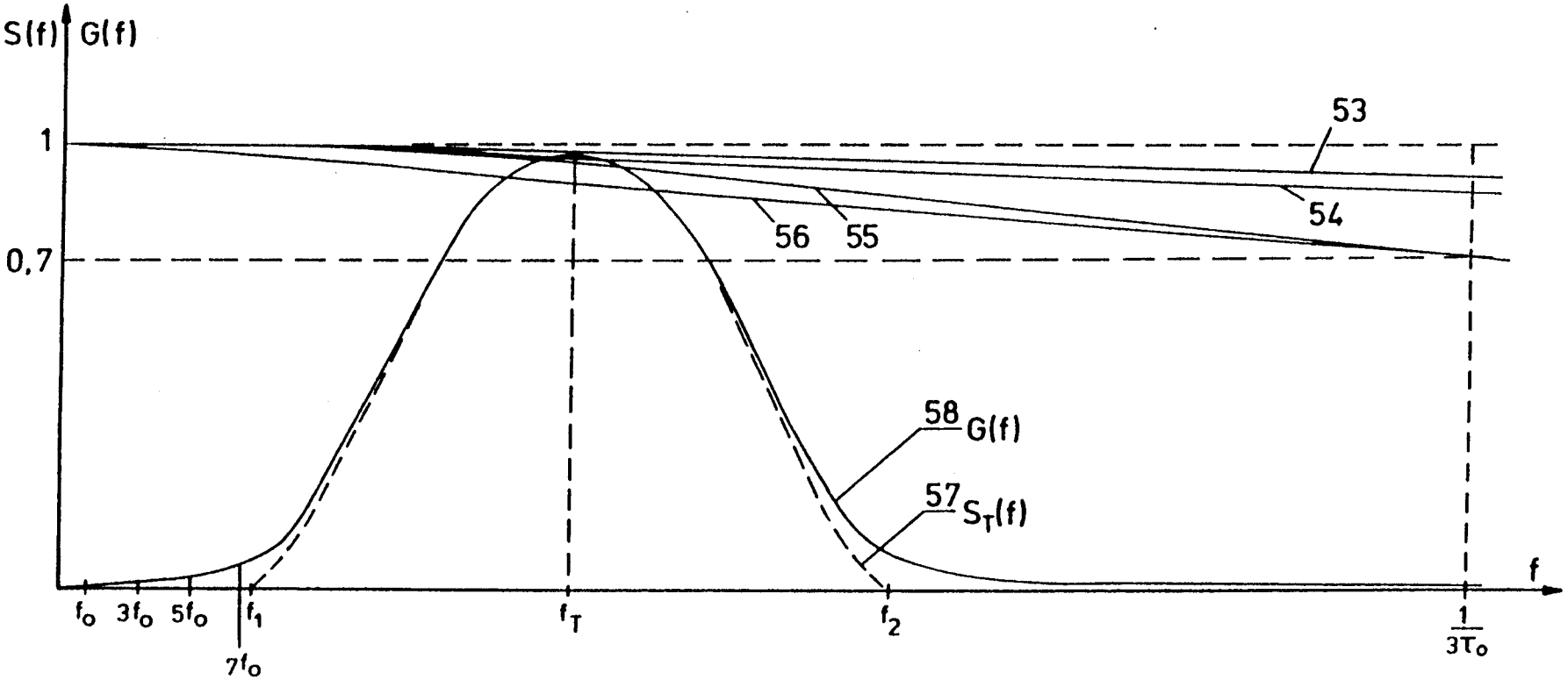
FIG. 8 illustrates a method of modification of the tag signals according to the present invention.

FIG. 8 is an enlarged top section of the first and most powerful band of the spectra in FIG. 7. As can be seen from FIG. 8, within the frequency range from zero to approximately $$\frac{1}{3\tau_o}$$

the spectra S(f) (53–56) of the differently shaped original tag signals are practically flat and this is what all these different spectra have in common. Therefore, according to the present invention, this flat portion of the original tag signal spectrum is used to transform and thus modify different kinds of original tag signals into a standard tag signal with an apriory specified shape. Such a modified tag signal is an amplitude-modulated AC-pulse with carrier frequency $f_T$, duration $\tau_T$ and an apriory defined geometry of an envelope. The spectrum of this modified tag signal is derived from the described above flat top portion of the spectra of the differently shaped original tag signals. The modification of an original tag signal is done by a synthesizer (52 in FIG. 6) which has gain-versus-frequency characteristic G(f) similar to the spectral function $S_T(f)$ of the modified tag signal (at least within the band where the vast part of this modified tag signal energy is located).

As has been mentioned previously, the upper limit for the frequency band of this synthesizer is set by a frequency $$f_{max} = \frac{1}{3\tau_o}$$

at which the "flat" portion of the original tag signal spectrum starts rolling off (note that the limited bandwidth of the active components in the receiver circuitry—such as operational amplifiers—contribute to this roll-off process, too).

Figure 9:
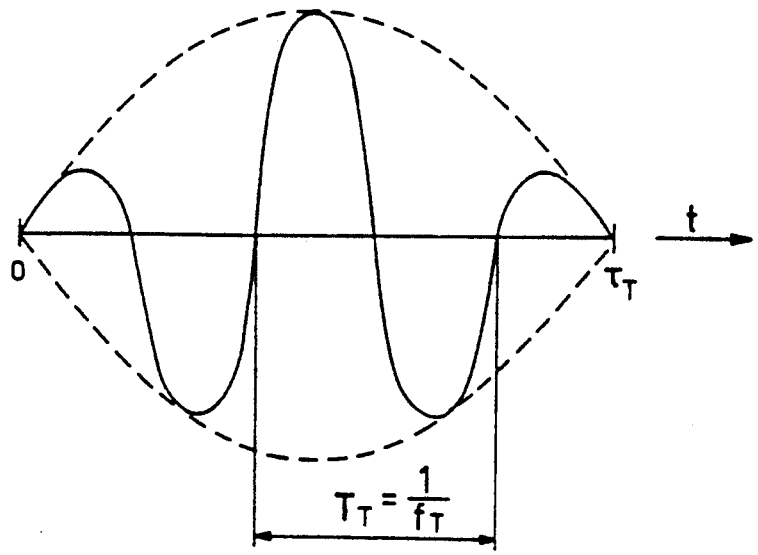
FIG. 9 shows the tag signal modified according to the method of the invention.

A band of the synthesizer has a lower limit $f_{min}$ which should be higher than the highest frequency notched by the filters in order to suppress the harmonics of the interrogation field. The band limitation imposed on the synthesizer demands that the modified tag signal has to have negligible side bands of its spectrum and most of its energy to be concentrated in the central band of the spectrum and this central band in its turn must be within the limits $[f_{min}-f_{max}]$. This condition is met excellently by an AC-pulse with an envelope described as $$\sin \frac{\pi}{\tau_T} t$$

existing only when $0<t<\tau_T$, where $\tau_T$ is the duration of this pulse and also the half a period of its sinusoidal envelope. Therefore, in the preferred embodiment of the present invention the modified tag signal has been given such a "half period of a sine" envelope as illustrated in FIG. 9. The theoretical spectrum $S_T(f)$ as shown in FIG. 8 by the dotted line (57) and the practical characteristic G(f) of the synthesizer is given here as curve 58. This curve (58) is marked at the four points corresponding to the first four consecutive odd harmonics of the interrogation field suppressed by the notch filters 47, 49, 50 and 51 in FIG. 6.

It is clear now that the synthesizer (52) is a kind of band-pass filter. There are different ways to design the synthesizer. In the preferred embodiment it is done by the use of an elementary (single pole) R-C filters in both high-pass and low-pass configurations. The G(f)-characteristic of the synthesizer is symmetrical around the central frequency $f_T$ in a manner described as $|G(f_T-f)|=|G(f-f_T)|$. Therefore the number of low-pass R-C filters used in the synthesizer is greater than the number of high-pass R-C filters and, moreover, these elementary R-C filters, in general, have their poles set at different frequencies in order to create a G(f)-function close enough to the theoretical spectral function $S_T(f)$ of the modified tag signal. When the G(f) function of the synthesizer has a good similarity to the spectral function $S_T(f)$ of an AC-pulse with a sinusoidal envelope (as is shown in FIG. 8) then the frequency $f_T$ of the modified tag signal will be close to the central frequency of the spectrum $S_T(f)$ and the duration $\tau_T$ of the modified tag signal will be close to the theoretical value $$\tau_T = \frac{3}{f_2 - f_1},$$

where $(f_2-f_1)$ is the width of the central band of the spectrum $S_T(f)$.

Figure 10:
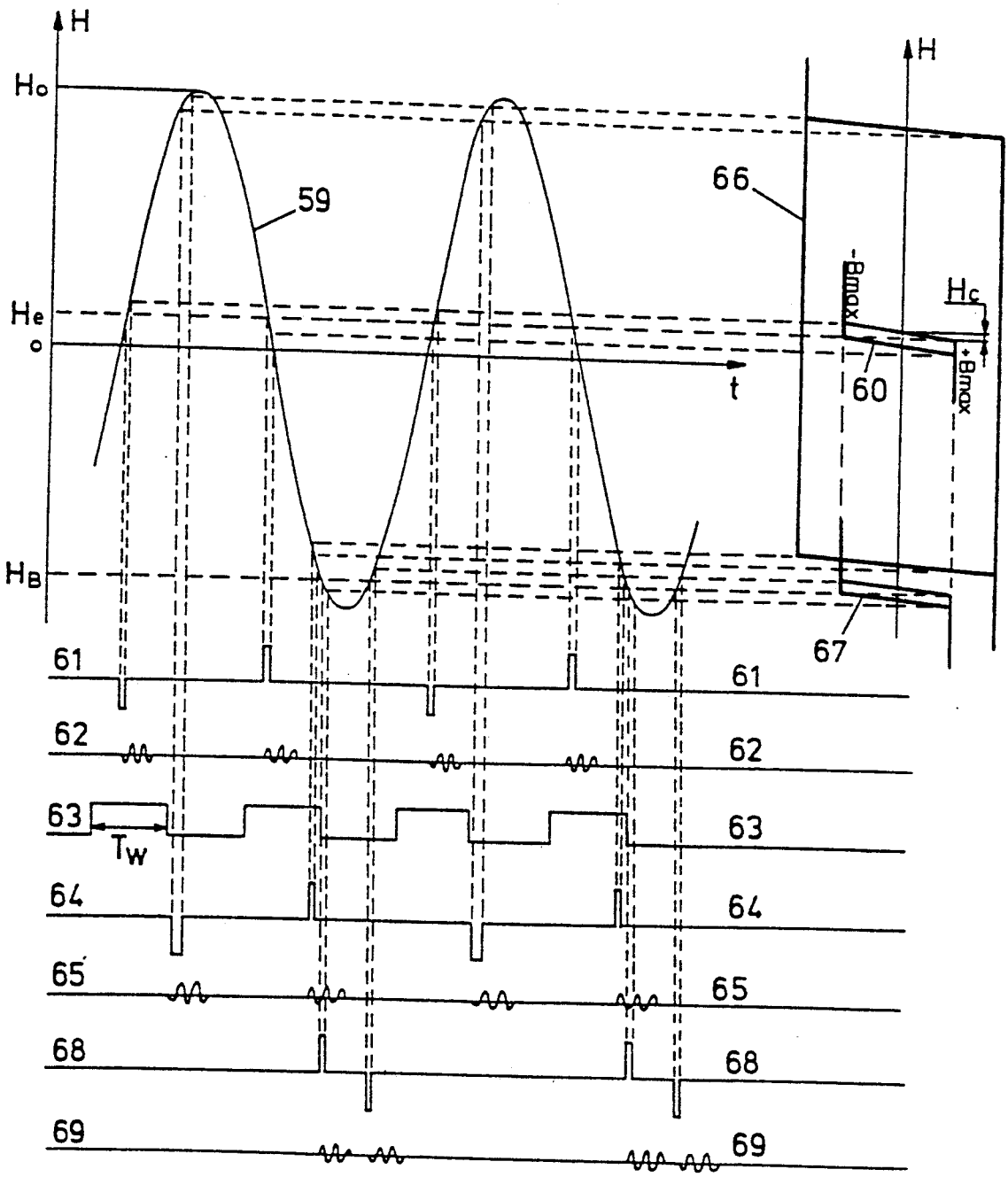
FIG. 10 is a time diagram illustrating different signals originated in the interrogation field and also explaining the positions of the time-windows according to the present invention.

FIG. 10 shows the sinusoidally varying interrogation field $H_o \sin(\omega_o t)$ interacting with the magnetic material of the tag, biased by the earth magnetic field $H_e$. The hysteresis loop, as shown in FIG. 10, is linearly sloped, saturated at inductance levels of $+B_{max}$ and $-B_{max}$ and has a coercive force of $H_c$. In order to generate tag signals the level of the interrogation field should always satisfy the condition of $H_{omin}>H_e+2H_c$. The earth magnetic field varies from the minimum of 10 A/m at the equator to the maximum of 80 A/m at the earth's poles and in most populated areas where the use of the system of the present invention is relevant $H_e \leqq 50$ A/m, whereas the typical value of a coercive force $H_c$ of soft magnetic materials used for security tags is less than 1 A/m.

The choice of $H_{omin} \geqq 100$ A/m satisfies the inequality $H_{omin} > H_e + 2H_c$ in a strong way which assures that the original tag signals (61), as can be seen from FIG. 10, will be located in a relatively close vicinity to zero-crossings of the interrogation field, although the exact position of the tag signals, in principle, is unknown, being a function of many variables such as magnetic properties of the tag material, the position and orientation of the tag in the interrogation field, the strength and spatial distribution of this field, the bias provided by earth's magnetic field and so on.

The duration of a positive tag signal is also different from that of a negative tag signal, but the closer their positions to zero-crossings of an interrogation field are, the smaller the difference would be. The duration of an original tag signal can be calculated approximately as $$\tau_o = \frac{H_c}{\pi f_o H_o}.$$

For the values of $H_c = 1$ A/m, $f_o = 2$ KHz, and $H_o = 100$ A/m, the duration $\tau_{omax}$ would not be longer than 2 μsec.

Under the worst case assumption that $\tau_{omax} = 3$ μsec at $f_o = 2$ KHz the upper limit of the synthesizer band (FIG. 8) would be $f_{max} = 111$ KHz whereas the lower limit would be $f_{min} = 7f_o = 14$ Khz. This allows the following time related parameters to be used in the preferred embodiment of the system:

The nominal value of the frequency of the interrogation field is $f_o = 1953$ Hz.

The carrier frequency of the modified tag signal is $f_T = 39$ KHz, which makes the period of this frequency equal to 25.6 μsec.

The duration $\tau_T$ of the modified tag signal is equal to 64 μsec, which is much shorter than the half of period (256 μsec) of the interrogation field.

According to the present invention an inequality $$\tau_T << \frac{1}{2f_o}$$

is very important to the signal processing as will be disclosed hereafter.

It will be also appreciated that any other values of those time related parameters can be used in the system as long as the product $\tau_o f_o$ is maintained at the same rather conservative level of 2 KHz × 3 μsec = 0.006.

The modification of the tag signals by itself does not endow them with any unique distinctive features because any relatively narrow spike of an external noise will be transformed by the synthesizer into a signal shaped like a modified tag signal. The importance of the modification lies in the transformation of a tag signal originally shaped as a video pulse into a AC-pulse with an apriory known carrier frequency $f_T$. In the system according to the present invention, the modified signal will be treated by methods of synchronous detection and a certain use of these methods, as will be shown later, not only will provide a simple and easy way for build up of signal to noise ratio, but also will be instrumental for a deliverance from external periodic noise originated, for example, by horizontal deflections of various video monitors (T.V., computerized cash registers, etc.).

It is well known and commonly used method when in order to minimize noise penetration while conducting a search for discrete signals a system has to maximally narrow down the intervals where the signals of interest can be situated. These intervals are usually known as "windows". The modified tag signals (62, FIG. 10) are discrete signals and therefore the system of the present invention uses the windows technique. Although the exact locations of the tag signals (i.e. initial phases of the modified tag signals) are unknown, as explained previously, their approximate positions are known to be near corresponding zero-crossings of the interrogation field. Thus, in order to accommodate all possible locations of the modified tag signals each window (63) starts some time before corresponding zero-crossing and ends some time past the same zero-crossing, being long enough to contain the modified tag signal (62) considering all possible deviations in the initial phase of this signal. All window (63) have the same duration $T_w$ and each window is separated by gaps from the neighbouring windows.

Gaps are important for the following reasons. A metal object, for example a shopping cart, made of a hard magnetic material (such as iron or nickel) can become magnetically saturated by the interrogation field, and will therefore generate a signal (64) which upon modification (65) can be mistaken by the system for a modified tag signal. These hard magnetic materials have a much wider hysteresis loop (66) than the soft magnetic materials have. Therefore in order to saturate objects made of hard magnetic material a much stronger field is required and in many cases signals resulting from the these objects in the field with a moderate strength will coincide with the gaps where because the sinusoidal interrogation field (59) is stronger than it is in the windows. However, when a metal object made of hard magnetic material is in a close proximity to one of the transmitting coils where the field is rather strong, then the signals generated by this object can be close enough to the field zero-crossings and may penetrate the windows.

All this applies to deactivated tags as well. As is well known the security tag comprises not only a soft magnetic material strip but also a number of chips made of hard magnetic material. The tag is deactivated by magnetizing these chips. Their residual field $H_b$ biases the narrow hysteresis of the tag (67, FIG. 10) which no longer will be affected by the interrogation field as long as the field is weaker than $H_b$. But if the deactivated tag is placed in a field stronger than the bias $H_b$ (e.g. in close proximity to a transmitting antenna), then it will be resaturated periodically and will generate tag signals again as shown by lines 68 and 69 in FIG. 10. Being originated by a very strong field these spurious signals could appear in the windows just as the spurious signals from metal objects could. According to the present invention such signals will also be ignored by the system, as will be explained before long.

Figure 11:
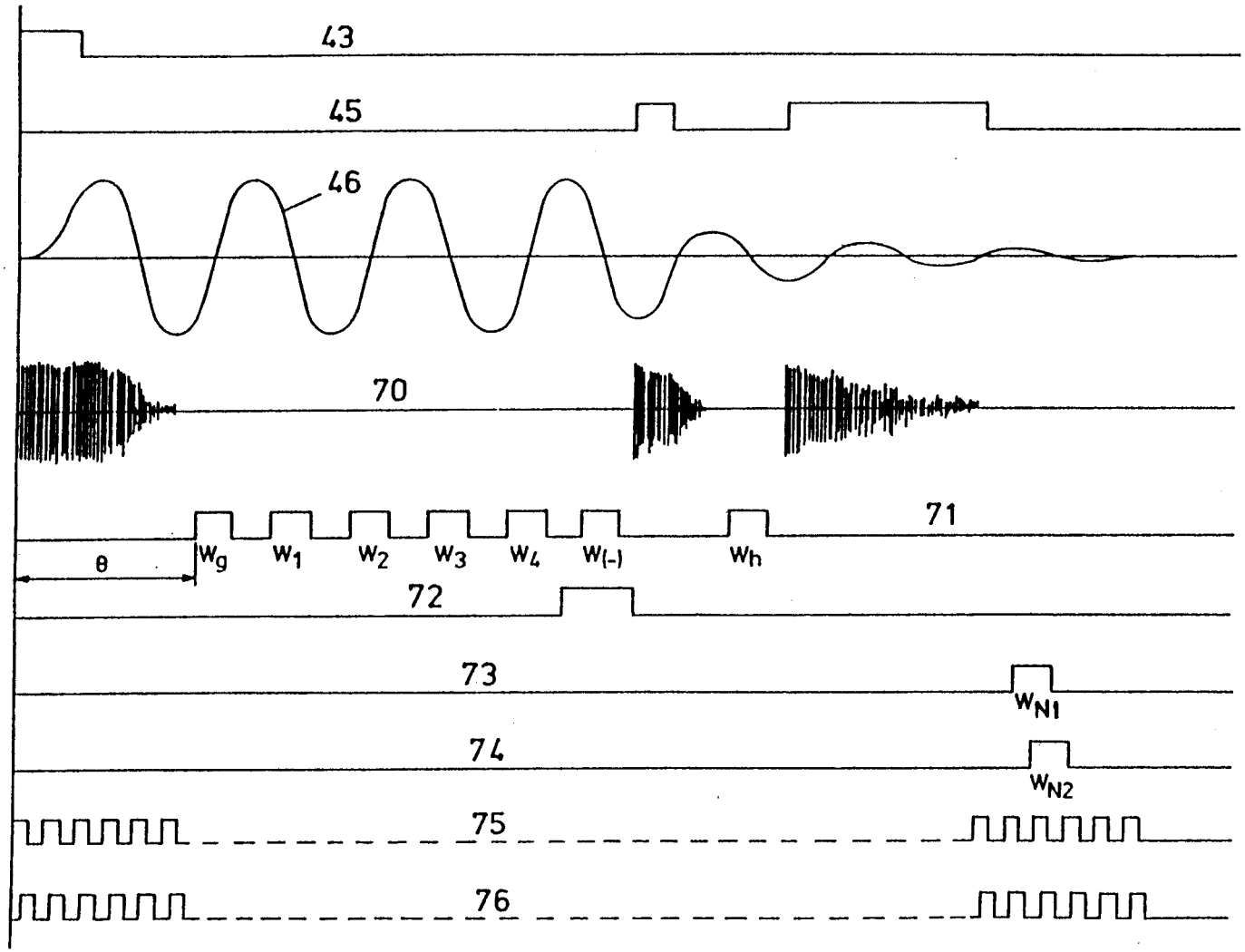
FIG. 11 is a time diagram showing a set of controller commands in the signal processor according to the invention.

FIG. 11 is a time diagram containing a set of controller commands entering the signal processor during every one of the several transmission periods constituting the full surveillance cycle. The first three lines (43, 45, and 46) in FIG. 11 are repeated from FIG. 4 for explanatory purposes, showing command 43 initiating every transmission pulse 46 (and, thus, the transmission period itself) and command 45 changing the intensity level of the field (46). Every time when commands 43 and 45 cause a significant change in the monotony of the field (46), a noise (70) occurs at the output of the receiver, and windows $W_g$, $W_h$, and $W_{N1}$ will not be open before this noise dies down. The train of windows (71) has very stable time parameters assured by the use of a crystal clock in the controller (14). The windows train (71) can be seen as a periodic process with a few windows (between $W_{(-)}$ and $W_h$) missing. The period of the windows train is equal to the value $$\frac{1}{2f_o}$$

of half a period of the interrogation field (46) frequency. A possible deviation of an actual field frequency from its nominal value $f_o$ has been taken into consideration by giving the windows an extra length in order not to miss any of the expected modified tag signals. For reasons to be explained hereafter, the interval $\theta$ between the moments where the transmission of the field (46) and the train of windows(71) start, can be different for different transmission periods discretely deviating from its nominal value $\theta_o$ by $$\pm\frac{T_T}{2},$$

where $T_T$ is the period of the modified tag signal. This deviation has also been considered by giving an extra duration to the windows.

The very first window $W_g$ in the train (71) is meant for an automatic setting of the system gain each time the surveillance cycle starts, so that the window $W_g$, although being formed for every transmission period, is active in the very first one only, setting the proper gain which will be maintained for the duration of the entire surveillance cycle. The preferred practical way of an automatic gain setting will be described later on.

The windows between $W_g$ and $W_{(-)}$ are "main" windows searching for the modified tag signals. Four main windows $W_1$-$W_4$ are used in the preferred embodiment of the system.

Windows $W_{(-)}$ and $W_h$ are auxiliary windows. They are used to check whether the signals discovered in the main windows have been true (being originated by an active tag) or whether they have been generated in a strong field either by a metal object or by a deactivated tag. This discrimination is based upon the assumption that when placed in the middle part of the security zone (where the field is weakest) neither a metal object nor a deactivated tag will produce a signal which could be seen in the main windows $W_1$-$W_4$.

As was stated previously and shown in FIG. 1, the signal processor (18, for example) gets signals (20 and 21) from both receivers 15 and 16. These signals obviously must enter the signal processor in such a manner as to be summed and not subtracted from each other. The summing mode is maintained throughout the transmission period except for an interval (line 72, FIG. 11) where the first auxiliary window $W_{(-)}$ is located. Following command 72 the summing mode of the signal processor is changed for a subtracting mode. If the main windows $W_1$-$W_4$ indicate the presence of a signal and there is no signal in window $W_{(-)}$, then the logical conclusion will be drawn that the signal is a true tag signal. However, if there were still a signal in the window $W_{(-)}$, then it could be equally due to an active tag, metal object, or a deactivated tag when either one of them is displaced closer to one of the transmitting antennae (3 or 4) where the field is much stronger than in the middle of the interrogation zone (1).

In order to verify whether this signal is a true tag signal or not the second auxiliary window $W_h$ is employed. This window is used when, following the first of the commands (45), the strength of the interrogation field 46 has been reduced by predetermined factor. If the signal still appears in the window $W_h$, although attenuated to approximately the same degree as the field 46 has been, than the signal must be true. A false signal generated by a metal object or by a deactivated tag will not appear in the window $W_h$ because in a weak field nothing but a true tag signal can be observed in the windows.

As a general principle, no reliable judgement regarding what has been observed in a window (just a noise or possibly a tag signal) can be made without a threshold value based upon knowledge of the noise level in the system. According to the present invention, in order to monitor the noise and to produce a valid threshold, another pair of auxiliary windows $W_{N1}$ and $W_{N2}$ (73, 74) is used when the interrogation field 46 has been dumped for the second time by command 45 to practically zero-level. Thus, nothing related to the field 46 can interfere with the study of noise.

Both windows $W_{N1}$ and $W_{N2}$ (73, 74) have the same duration $T_W$ as the windows of the train (71) have. For reasons to be given later the window $W_{N2}$ (74) always lags behind the window $W_{N1}$ (73) by $$\frac{T_w}{2},$$

and in its turn the window $W_{N1}$ is rigidly synchronized with the train of windows (71). The windows (71), (73) and (74) are forming a window cycle.

The contents of all the windows (71, 73, 74) except for $W_g$ are subject to exactly the same processing procedures, which utilize methods of synchronous detection with the purpose of locating the modified tag signals in a noisy environment. These methods, according to the present invention, are using two periodic reference waves (75 and 76) both starting at the beginning and going on throughout every transmission period. Both reference waves (75, 76) have identical periods equal to the period $T_T$ of the modified tag signal and they both are symmetrical having a duty-cycle of 50%. The only difference between them is a phase difference which is 90° (or in terms of time the shift is $$\frac{T_T}{4}).$$

The wave (75) is considered to have zero as its initial phase and named as "in-phase reference". Therefore the second wave (76) has been named "quadrature reference".

The synchronous detection methods, as used according to the present invention, will be explained now to full extent using as a working example one window only ($W_1$ for instance). These methods are illustrated by FIG. 12, which is a block-diagram of the synchronous detector as used in the preferred embodiment of the system.

As is well known in the art, when an AC-signal $A^* \sin(\omega t+\phi)$ is applied to the signal input of a phase detector and a waveform of the same frequency is applied to the reference input, then the DC-component of the phase detector output obtained by low pass filtering will be proportional to $A^* \cos \phi$ if the initial phase of the reference signal is considered to be zero. But if the initial phase of the reference is 90° then the output of the phase detector will be proportional to $A^* \sin \phi$.

Figure 12:
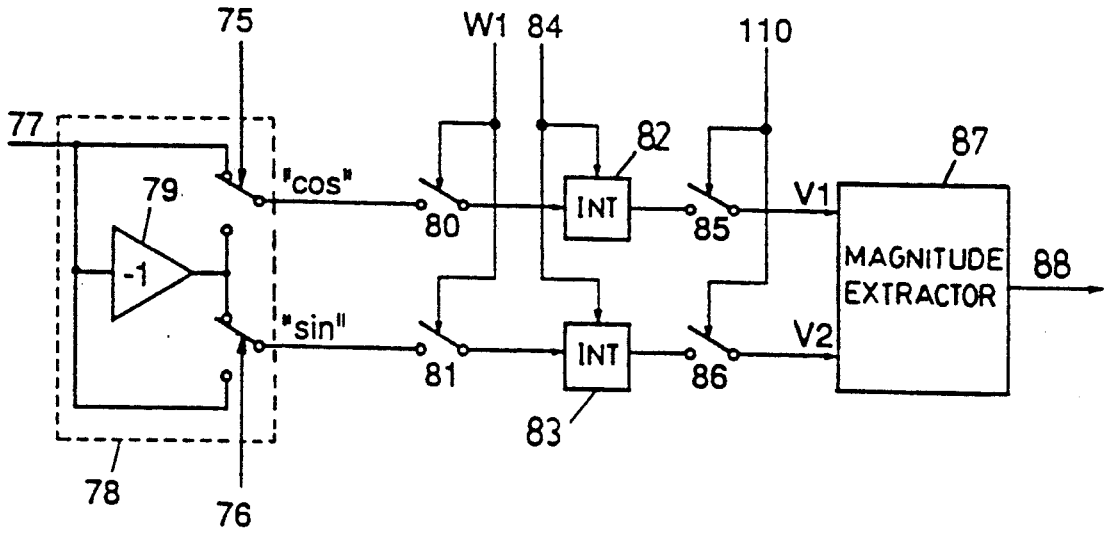
FIG. 12 is a block diagram of the synchronous detector as used in the preferred embodiment of the invention.

In FIG. 12 block 78 is a double-output phase detector, comprising an inverting unity gain amplifier (79) and two double-throw analog switches one of which is controlled by the "in-phase" reference (75) and the second is controlled by the "quadrature" reference (76). So when the modified tag signal 77 (which can be described as $A^* \sin (\omega_T t+\phi)$, providing that its envelope, as a function of time, is significantly slower than its carrier) is applied to the analog input of the phase detector (78), then the low-frequency components of respective output signals will be $A^* \cos \phi$ and $A^* \sin \phi$. If the modified tag signal (77) happens to be within the window $W_1$, when the switches 80 and 81 are in conductive mode, then the signals containing DC-components $A^* \cos \phi$ and $A^* \sin \phi$ from the outputs of the phase detector (78) will be applied to the inputs of integrators 82 and 83 respectively. The use of integrators 82 and 83 here is multi-functional:

a. They can be used for a synchronous accumulation of a number (n for example) of modified tag signals presented in different but identically numbered windows ($W_1$ for example), each window located in one of n different window cycles forming, which constitute together an accumulation cycle. Different modified tag signals of the same transmission period have different initial phases due to various factors such as an asymmetry of the tag hysteresis or the earth magnetic field biasing the interrogation field, which by itself can be decaying when running freely. Therefore the modified tag signals within the windows of the same transmission period have different phases and cannot be synchronously accumulated. However, in corresponding windows of different transmitting periods the modified tag signals are mutually in-phase, which allows to accumulate them synchronously.

b. These integrators, under special conditions to be disclosed hereafter, can significantly reduce the interference of a periodic noise caused by various sources (such as video monitors of computers, TV, or cash registers for example).

c. The integrators (82, 83) can be used as low-pass filters to recover DC-components $A^* \sin \phi$ and $A^* \cos \phi$ from the output signals of the phase detector (78). Each of the integrators causes a phase shift of 90° between its output and input signals. Thus, at the end of every integration interval (which is the duration $T_w$ of each window) the output levels of the integrators (82, 83) will be changed by increments of $KA^* \sin \phi$ and $KA^* \cos \phi$ respectively. The coefficient K reflects the time constant of each integrator and the duration $\tau_T$ of the signal (77).

The integrators (82,83) are reset by command 84 prior to the beginning of every accumulation to cycle. At the end of the accumulation cycle output levels of the integrators (82, 83) obtain values of $V_1=M^* \sin \phi$ and $V_2=M^* \cos \phi$, where $M=KnA$.

And now, after the completion of the accumulation cycle, which is a linear part of the signal processing, both output levels from the integrators (82, 83) can be applied to the inputs of a "magnitude extractor" (87) via respective switches (85, 86) controlled by command 110. The magnitude extractor is set to execute the non-linear mathematical operation $$\sqrt{V_1^2 + V_2^2}\ .$$

Figure 13:
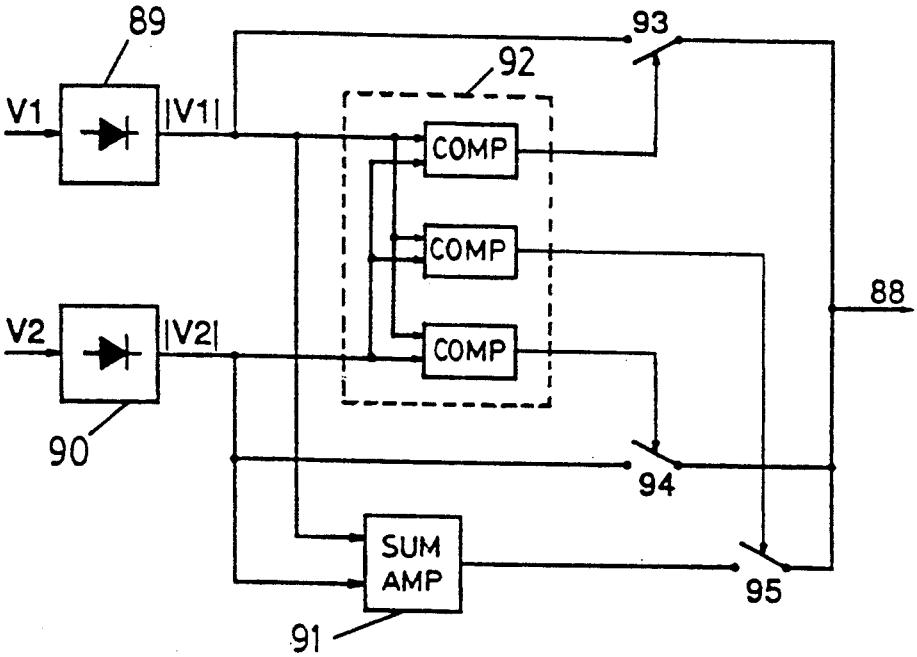
FIG. 13 shows in a block-diagramtical form the preferred embodiment of the magnitude extractor.

The simple and therefore preferred embodiment of the magnitude extractor (87) is shown as a block diagram in FIG. 13. It comprises: two full wave rectifiers (89, 90) providing at their outputs absolute values $|V_1|$ and $|V_2|$ of the respective input levels; a summing amplifier (91) with the gain of 0.75; unit 92 containing three voltage comparators, and analog switches (93, 94 and 95) controlled by corresponding comparators of the unit (92). The algorithm is simple:

when $|V_1|>3\ |V_2|$, switch 93 passes level $|V_1|$ to the output (88), when $|V_2|>3|V_1|$, switch 94 is closed providing the output with level $|V_2|$, and when $$3 > \left|\frac{V_1}{V_2}\right| > \frac{1}{3}$$

the output level via switch 95 becomes equal to $0.75(|V_1|+|V_2|)$.

Following this algorithm the output level 88 of such a magnitude extractor will be approximately $$\sqrt{(M\sin\phi)^2 + (M\cos\phi)^2} = |M| \propto |nA|.$$

with an error of less than 5% for the full range of values of $\phi$.

This level 88 is proportional to the magnitude resulting from the synchronous accumulation of n modified tag signals, and is independent of their unknown initial phase $\phi$, no matter what positions these signals occupy within their windows. The last statement is true because the initial phase $\phi$ of a modified tag signal is measured with respect to the beginning of the transmission period to which this signal belongs and not to the beginning of a window surrounding this signal.

Figure 14:
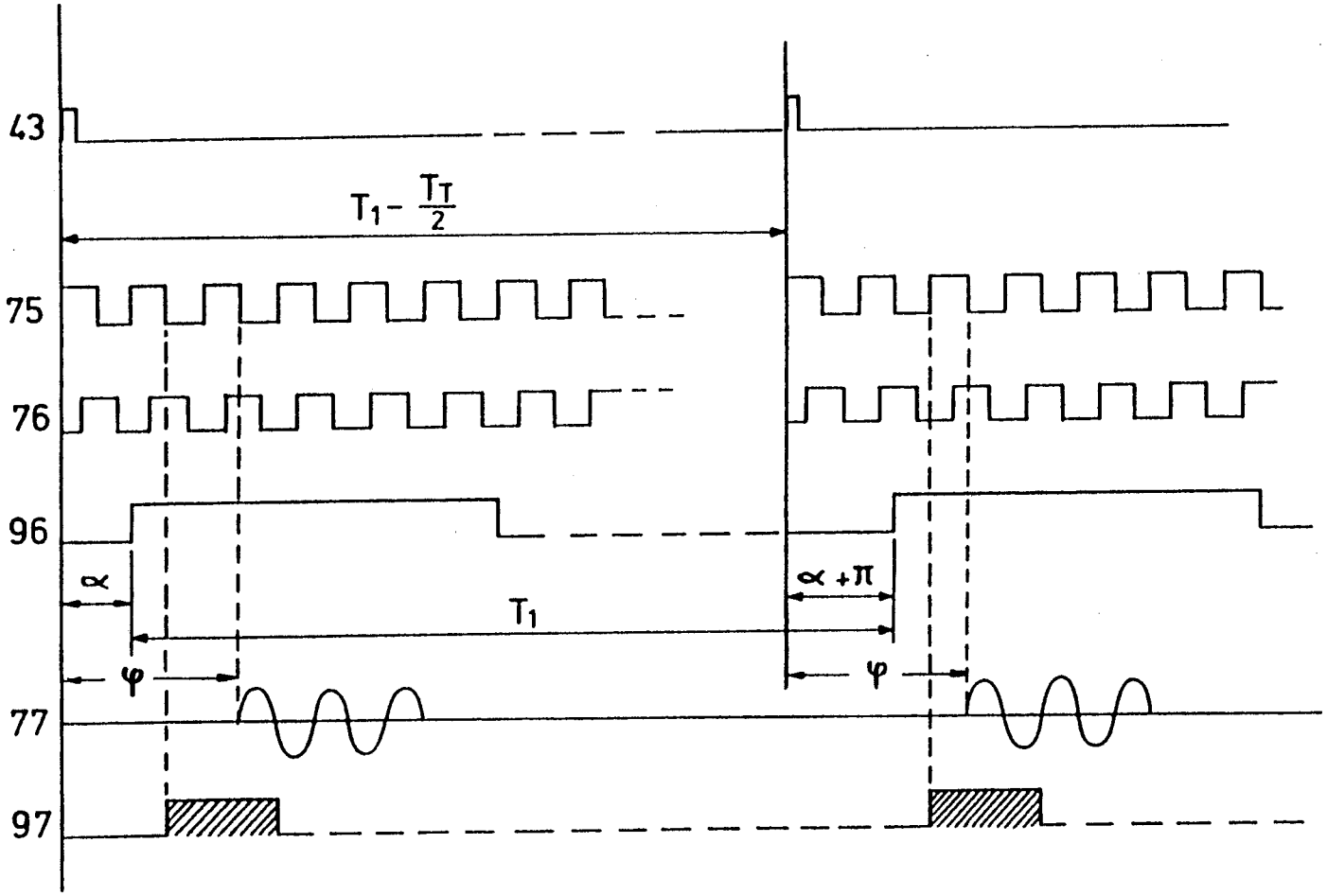
FIGS. 14 and 15 illustrate, in a time-diagramatical form, the method of suppressing periodic noises according to the present invention.

The fact that the windows are movable, to the extent to which they still embrace their modified tag signals, is used in the present invention to suppress a periodic noise, as illustrated by FIG. 14. Parts of two window cycles, which together make up an accumulation and respective cycle are shown here in the form of a time diagram. Each window cycle transmission period starts by command 43 at which moment the in-phase and quadrature reference waveforms (75, 76) start also. Two corresponding modified tag signals (77) in both window cycles have identical initial phases $\phi$, being originated by identical parts of the interrogation fields (not shown), which are identical in both transmission periods. These signals (77) are well within their windows (96) which are shifted with respect to each other by half a period $T_T/2$ of the reference waves (75, 76). According to the recent explanation, at the end of the second window (96), the output levels of integrators 82 and 83 (FIG. 12) will be doubled and, thus, the output level (88) of the magnitude extractor (87) will be doubled, too.

Figure 15:
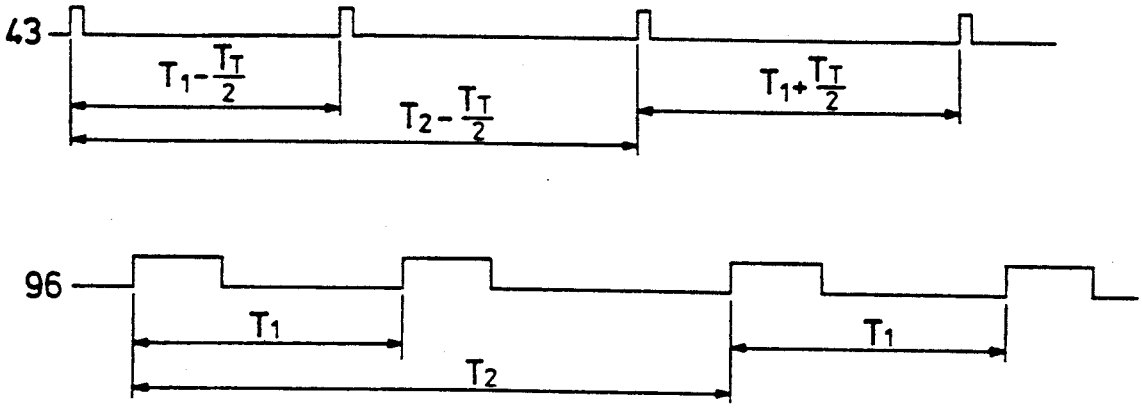

Quite a different effect takes place when the system is affected by a periodic noise, which is in synchronism with the corresponding windows (96) in both window cycles (the periodic noise is shown in line 97, FIG. 14 by the shaded areas). Both reference waveforms (75, 76)

within the second of the two windows (96) are phase shifted by 180° with respect to their phases during the first window. Therefore the changes in the output levels of the integrators (82, 83) obtained due to the periodic noise (97) during the first window (96), will be cancelled by the end of the second window (96), if the interval $T_1$ between these windows contains an integer of the noise periods $T_{N1}$. Thus, the system of the present invention, having the accumulation cycle of two window cycles with an interval between their starting points which differs by half a period $T_t/2$ of the reference waveforms (75, 76) from the interval $T_1$ between the moments where two respective trains of windows start, will reject all periodic noises with repetition rates being multiples of $f_{N1min}$, for which $T_1 f_{N1min}$ is still an integer. Such a plurality of periodic noises will hereafter be referred to as a "group of periodic noises". If the modified tag signal is also present in those windows (96), the output level (88) of the magnitude extractor (87) will reflect a doubled magnitude of the modified tag signal, whereas a random noise contribution to the output level (88) will be diminished. If needed, the signal to random noise ratio can be increased, whilst still rejecting one group of periodic noises, by the use of an extended accumulation cycle, consisting of more than one pair of window cycles, each pair arranged in accordance with the method described above and illustrated by FIG. 14. This method can be extended in order to reject more than one group of periodic noises. FIG. 15 is a visual example of an accumulation cycle structured in such a way that two different groups of periodic noises with repetition rates which are multiples of $f_{N1min}$ and $f_{N2min}$ will be rejected when $T_1 f_{N1min}$ and $T_2 f_{N2min}$ are integers.

It is easy to see that the minimal number n of window cycles in an accumulation cycle needed for rejection of m groups of periodic noises is $n=2^m$. This shows that an addition of one to the number of basic frequencies $f_{Nmin}$ of the periodic noises to be rejected doubles the duration of signal processing and hence makes the system two times slower and also increases dramatically the duration of the search for the optimal values of $T_1$, $T_2$ etc. (the search procedure will be explained later on). However there is a simple method to eliminate a group of periodic noises with basic frequency $f_{Nomin}$ within the windows themselves without designing a suitable structure of an accumulation cycle. This internal method demands only one condition to be met and that is the duration $T_W$ of any window has to be equal to an odd number of periods $T_T$ of the reference waveforms (75, 76). In this case any periodic noise with repetition rate $f_{No}$ such that the product $T_w f_{No}$ is an even number will not cause any change in the output levels of the integrators by the end of any one window. For example, in order to reject noise of TV horizontal deflection (15,625 Hz) the shortest windows have to be 128 μsec long. Obviously the multiples of this frequency will be rejected, too.

Figure 16:
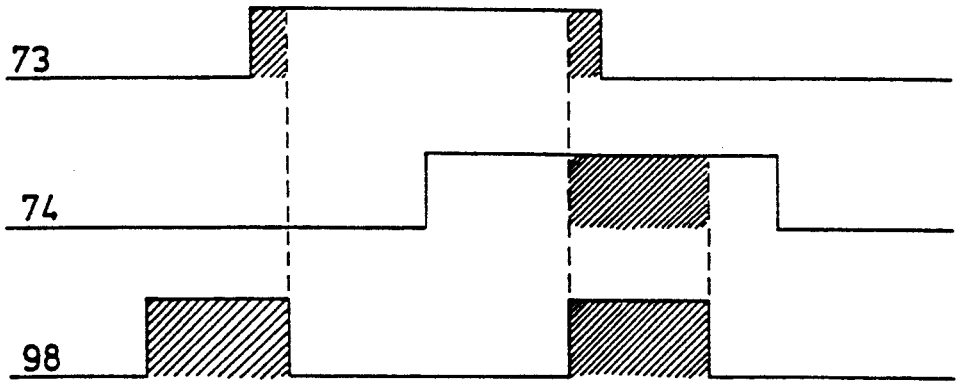
FIG. 16 is a time diagram explaining the use of two overlapping windows for the evaluation of noise

As has been described earlier, two auxiliary windows $W_{N1}$ (73) and $W_{N2}$ (74) are used in each transmission period being placed where the interrogation field (46, FIG. 11) practically does not exist. These windows are shifted relative to each other by half of their duration $T_w$. The purpose and use of this will be explained now with the help of FIG. 16.

The contents of these windows (73, 74) are also subjects to the synchronous detection using reference waveforms (75, 76). It well can be that in one of the windows, $W_{N1}$ (73) for example, not a whole pulse of the periodic noise (98) but only a rear and front fractions of two such noise pulses will be seen. In this case the magnitude of the noise can be greatly underestimated by the synchronous detector. But, as is clearly shown in FIG. 16, the second window $W_{N2}$ (74) has a whole pulse of noise (98). Therefore, according to the present invention, at the end of every accumulation cycle the output levels (88) of the magnitude extractor (87), which are related to the windows $W_{N1}$ (73) and $W_{N2}$ (74), are applied sequentially to a peak detector (124, FIG. 18), the output signal of which corresponds to the highest level of noise.

At the end of the surveillance cycle (which may contain a number of accumulation cycles) the output level (30) of the peak-detector (124) is used as a threshold value. The output level (30) of this peak detector (124) is also instrumental for a dynamic evaluation of the magnitude N of periodic noises during the search for optimal values ($T_1$, $T_2$, etc.) of the accumulation cycle.

The search procedures will be explained now, first using the search for the proper value of $T_1$ only as a basic example. In general the search can be described as a sweep along the values of $T_1$ in a certain range, using as a feedback (26, FIG. 1) the values N of the noise magnitudes which are matured at the end of each surveillance cycle.

The search comprises a number of stages, each of which can include more than one surveillance cycle in order to produce an average $\overline{N}$ of several values N and improve by that the accuracy of the evaluation of a periodic noise in the presence of other sporadic and random noises.

The interval $T_1$, as divided inside the controller (14) consists of two parts: a fixed one $T_{1min}$, which has not to be shorter than a duration of the transmission period, and a variable part $\Delta T_1$, which is being increased by an increment of $\Delta t$ at the end of every stage of the search. The search can start when either the noise $\overline{N}$ increases above some critical level or just becomes steadily greater than what it has been. The search also can be conducted periodically as a routine procedure, once every few minutes for example.

At the beginning of the search the initial value of $\Delta T_1$ is zero, so for the duration of the first stage the system will use $T_1=T_{1min}$. At the end of the first stage a new noise value $\overline{N}_1$ emerges and loads an "N-memory" which can be a "sample and hold" for example. Then $\Delta T_1$ gets its first increment $\Delta t$, so $T_1$ is set as $(T_{1min}+\Delta t)$ for the entire duration of the second stage. At the end of the second stage a new noise level $\overline{N}_2$ will be checked against the stored value $\overline{N}_1$. If $\overline{N}_2>\overline{N}_1$ then $\overline{N}_2$ will substitute $\overline{N}_1$ in the "N-memory" and the value of $\Delta T_1=\Delta t$ will also be latched, (into $\Delta T_1$-memory) as being the best so far. But if $\overline{N}_2>\overline{N}_1$, then the state of both memories will not be changed: the "N-memory" will stay with the value of $\overline{N}_1$, and the $\Delta T_1$-memory will still be memorizing zero. In any case at the very end of the second stage $\Delta T$ will be increased again by $\Delta t$, so that during the 3rd stage of the search $T_1$ will be set as $(T_{1min}+2\Delta t)$. At the end of the 3rd stage a new noise level $\overline{N}_3$ will be compared with the magnitude of noise stored in the "N-memory" and a decision regarding both (N- and $\Delta T_1$-) memories will be made based upon the results of this comparison in exactly the same way as described above. The $\Delta T_1$ will get yet another increment $\Delta t$ so that during the next ($4^{th}$) stage the system will operate with $T_1=T_{1min}+3\Delta t$, and so on.

If the number of search stages, predetermined by design, is S, then during the last stage the interval $T_1$ will have its maximal value $T_{1max}=T_1+(S-1)\Delta t$. At the end of the last stage in both "N" and "$\Delta T$" memories only the "best" values of the lowest level of noise $\overline{N}_b=\overline{N}_{min}$ and corresponding to it the optimal value of $\Delta T_{1b}$ will be stored. From now on until the next search the system will use the optimal value for $T_1$ which is $(T_{1min}+\Delta T_{1b})$.

The lowest level of noise $\overline{N}_b$ stored in N-memory can be used as a reference for the decision to start a new search when the current level of noise becomes much greater than $\overline{N}_b$. For this purpose, considering that the time interval between two searches can be rather long, a preference should be given to the organization of the N-memory in a digital way using an analog to digital conversion for example, rather than the "sample and hold" technique.

In the case when the system is designed to use two intervals $T_1$ and $T_2$ against periodic noises the interval $T_2$ should be broken into two parts as well (consisting of a fixed part $T_{2min}$ and a variable part $\Delta T_2$) and the controller (14) should have an additional $\Delta T_2$-memory. The search for the two best values of $T_1$ and $T_2$ follows, in general, the same pattern as has been described above, but it is now much longer because every combination of two variables has to be looked at. Therefore the search is organized in such a way that for every one of $S_2$ discrete values of $\Delta T_2=0, \Delta t, \Delta 2t \ldots (S_2-1)\Delta t$, the controller sweeps $\Delta T_1$ within the full range $[0-(S_2-1)\Delta t]$ of its $S_1$ discrete values. At the end of this search, consisting of $S_1 \times S_2$ stages, the best combination of the two values $\Delta T_{1b}$ and $\Delta T_{2b}$ will be stored in respective memories and, as well, the lowest noise level $\overline{N}_b$ related to the optimal combination of values T1 and T2 will be stored in the N-memory.

It is easy to deduce now that the number of stages of the search for the optimal combination of m intervals $T_1, T_2 \ldots T_m$ will be equal to $S_1S_2 \ldots S_m$.

In the preferred embodiment of the system according to the present invention every surveillance cycle consists of two similar accumulation cycles, each of which comprises two window cycles with the same time shift $T_1$ between them on both accumulation cycles. The optimal value of $T_1$ obtained during the search enables the rejection of the strongest of the periodic noises affecting the system, as has been explained previously and shown in FIG. 14.

The system is also designed to reject within each window, as has been method, disclosed previously, the second periodic noise which unlike the first one has a known basic repetition rate and that is the one of TV horizontal deflection (15,625 Hz) and is among the most common periodic noises (of course, the related parameters of the system can be chosen differently to accommodate the in-window rejection of any other fixed frequency).

Thus, the system is able to reject two groups of periodic noises (which is sufficient for most practical applications), while spending relatively little time to search for the optimal value of only one interval $T_1$.

In the preferred embodiment of the system according to the present invention the following parameters related to the cycling and to the search are used:

The duration of each transmission period is 5.4 msec. therefore the fixed part of $T_1$ is chosen to be $T_{1min}=5.5$ msec.

The variable part $\Delta T_1$ is being increased by increments of $\Delta t=2$ μsec, reaching its maximal value at $\Delta T_{1max}=64$ μsec, which makes the number of search stages S=32. The duration of the surveillance cycle containing 4 transmission periods is equal to 22.5 msec. Each stage of the search incorporates 5 surveillance cycles which makes for a total search time $T_{search}=22.5*10^{-3}\times 5\times 32=3.6$ sec (note that a search for two intervals $T_1$ and $T_2$ when $S_2$ is also 32 will take about two minutes).

Figure 17:
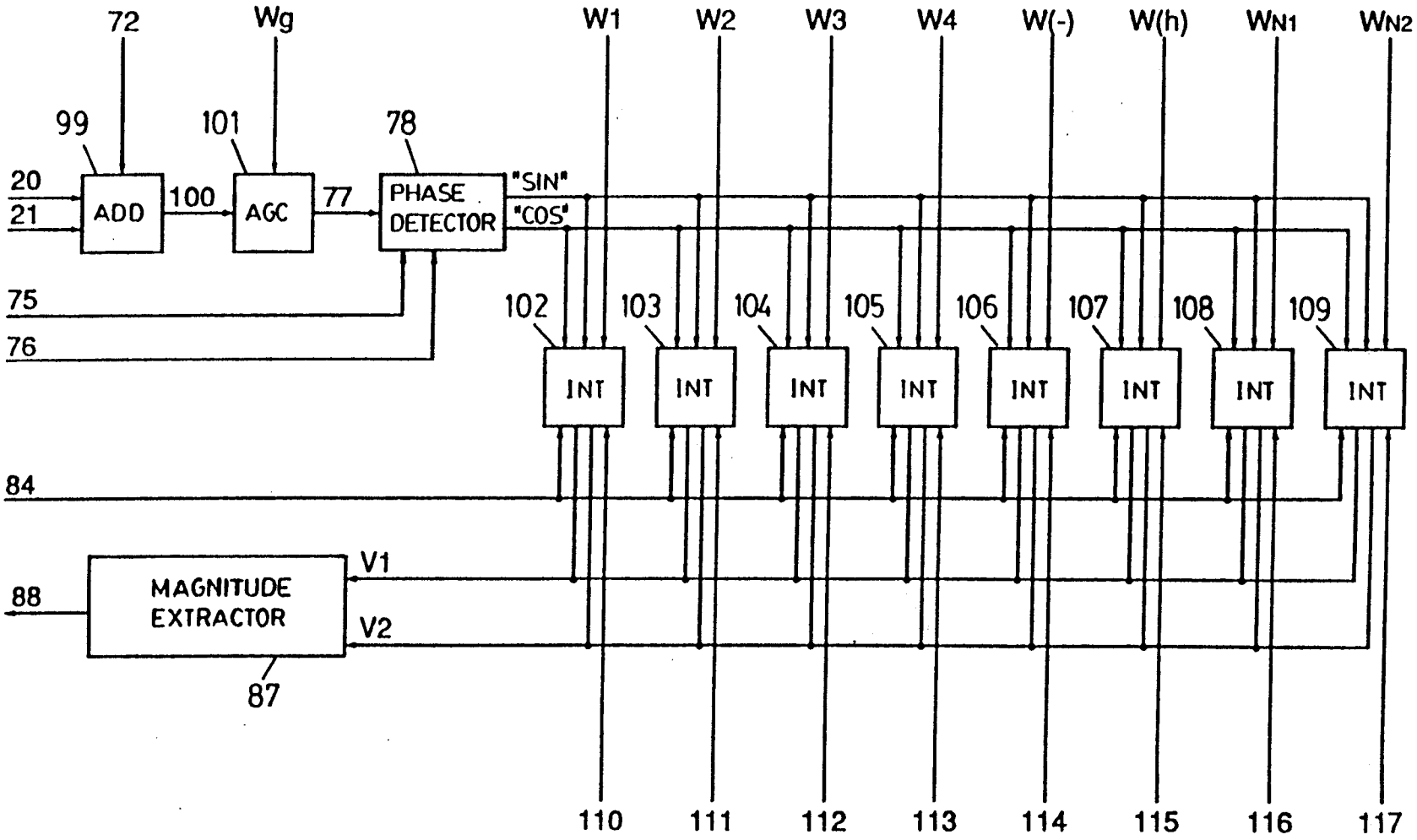
FIGS. 17 and 18 are two parts of a block diagram of a signal processor used in the preferred embodiment of the present invention.
Figure 18:
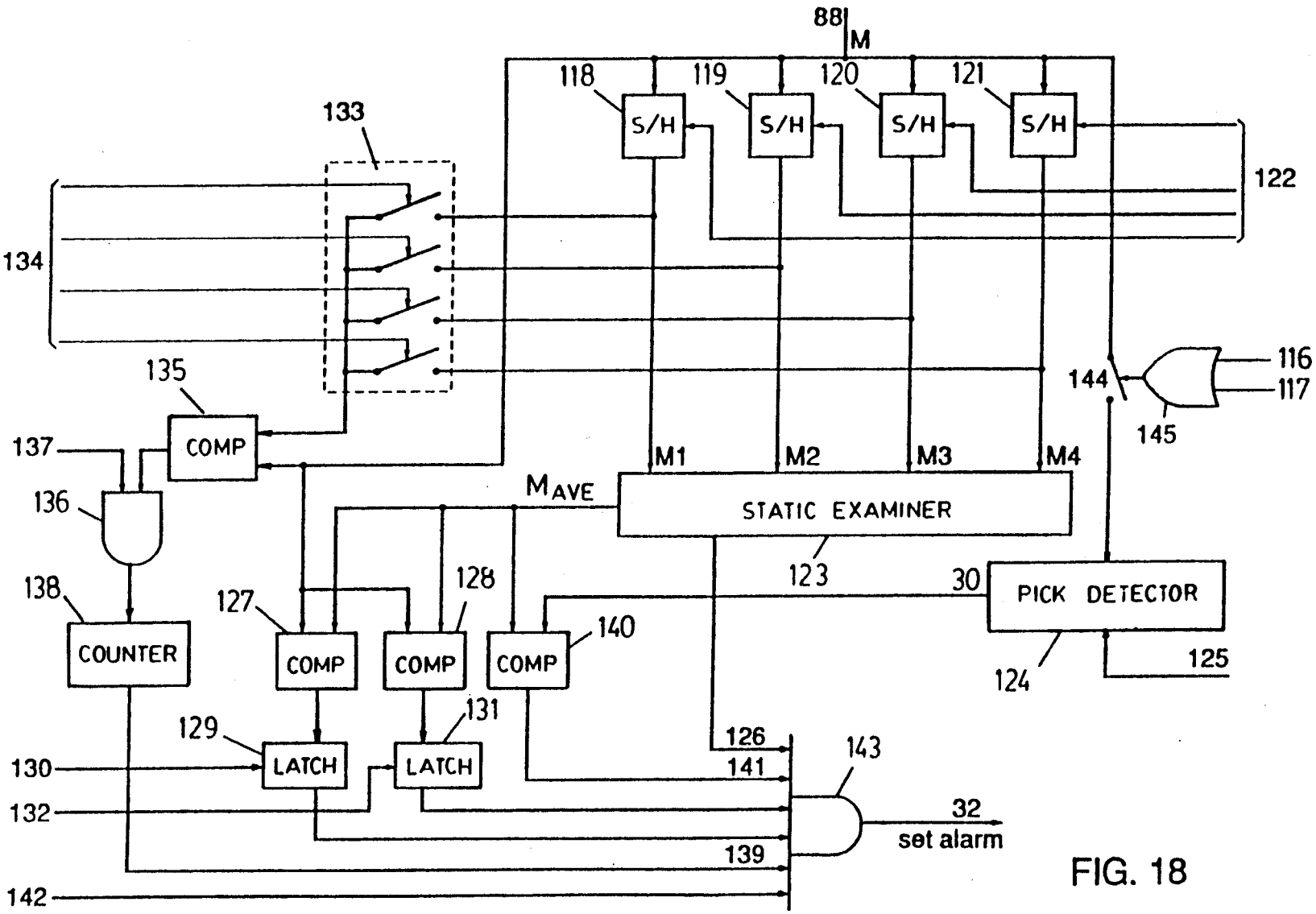

FIG. 17 and 18 are block diagrams of the first and second parts of the preferred embodiment of the signal processor (18, in FIG. 1 for example) suitable for use in a system according to the present invention. The output signals (20, 21) of the receivers (15 and 16, FIG. 1) are applied to the inputs of and adder (99, FIG. 17). The adder contains a switch (not shown) which upon receiving command 72 from the controller (14) changes the phase of one of the input signals (either 20 or 21) by 180°, thus causing the adder (99) to act as a subtractor for signals 20 and 21 once they are in the window $W_{(-)}$. At all other times the adder (99) is in a summing mode.

The output (100) of the adder (99) is connected to the input of an automatic gain selector (101). The working value of the gain is set during the very first window $W_g$ in the very first transmission period for the entire time of the surveillance cycle. The criterion of choosing the gain is that the signal (77) at the output of the gain selector (101) must not exceed a predetermined level which is below saturation.

The signal (77) is applied to the analog input of the phase detector (78), both reference inputs of which are supplied by in phase (75) and quadrature (76) reference waveforms respectively. Both outputs (" sin " and " cos ") of the phase detector (78) are connected to the respective inputs of eight identical units (102–109). Each of these units contains two integrators, the inputs and outputs of which are connected to their respective analog switches in a manner shown in that part of FIG. 12 which is located between the phase detector (78) and the magnitude extractor (87). All integrators in the units (102–109) are reset prior to the beginning of each accumulation cycle following command 84 from the controller (14).

The units (102–109) together with the phase detector (78) and with the magnitude extractor 87 (which is used on a time-sharing basis) constitute eight synchronous detectors dedicated to processing information contained in the eight respective windows ($W_1$–$W_4$, $W_{(-)}$, $W_h$, $W_{N1}$ and $W_{N2}$) as has been described above for window $W_1$. Each unit (102–109) supplies the integrals (i.e. the output levels $V_1$ and $V_2$ of its integrators) to the respective inputs of the magnitude extractor (87) following commands 110–117. The commands 110–117 are originated by the controller (14) during the last window cycle of every accumulation cycle (i.e. during the second and fourth transmission periods), after respective integrals in the units 102–109 have been matured. Commands 110–117 must not overlap in order not to violate the time-sharing use of the magnitude extractor (87). For that reason commands 110–115 lag behind the rear edges of corresponding windows ($W_1$-$W_4$, $W_{(-)}$, and $W_h$) of the train 71 (FIG. 11), whereas the commands 116 and 117, considering that windows $W_{N1}$ and $W_{N2}$ overlap, must act in series starting after the termination of the last window $W_{N2}$. Thus, during the second and fourth transmission periods the magnitude extractor (87) presents at its output (89) magnitudes $M_1$–$M_4$, $M_{(-)}$, $M_h$, $M_{N1}$ and $M_{N2}$ either of signal or of noise in the same order in which the windows ($W_1$–$W_{N2}$) follow each other.

The second part of the signal processing (FIG. 18) deals with the identification of the magnitudes (88) in order to make a decision regarding the necessity for an alarm.

At the end of each of the main windows $W_1$–$W_4$ in the second part of the first accumulation cycle (i.e. during the second window cycle) the respective magnitudes ($M_1$–$M_4$) become matured and are loaded into their sample and hold units (118–121) following commands 122 which are derived from commands 110–113. From now and until the end of the surveillance cycle these main magnitudes $M_1$–$M_4$ are stored, which enables the necessary checks to be performed throughout the whole surveillance cycle. The checks are divided into two groups: a static examination and a dynamic examination.

A static examination is done by the unit 123 to the inputs of which the values of the "main" magnitudes $M_1$–$M_4$, stored in the memories 118–121, are applied. The static examiner (123) contains a number of adders and comparators. One of the adders produces an average value $M_{ave}$ of all stored magnitudes $M_1$–$M_4$.

The rest of the adders and comparators in the static examiner (123) are used in order to check whether the ratios between different combinations of the stored values $M_1$–$M_4$ are within predetermined ranges which could point to the presence of a tag.

As is well understood, the biasing effect of the earth magnetic field is such that not only the initial phases but also the magnitudes of the modified tag signals originated by the positive transitions of an interrogation field (i.e. when the sinusoidal field is going up from its minimal value to the maximal one) will have, in general, different values from the ones obtained at the negative transitions of the field. That means that in the presence of a tag, the odd numbered values $M_1$ and $M_3$ are different from the even numbered ones $M_2$ and $M_4$, and the difference is much more noticeable in a weak field. But, strictly speaking, the magnitude values of the tag signals are not equal even within the same group: $M_1 > M_3$ and $M_2 > M_4$, due to an exponential decay of the field.

That is why, in order to establish whether the stored values $M_1$–$M_4$ could belong to the succession of the tag signals, the static examiner (123) compares them in pairs using its adders: each pair is a sum of two magnitudes taken from both ("odd" and "even") groups. In that way, when the tag is present, all these sums ($M_1+M_2$, $M_1+M_4$, $M_2+M_3$ and $M_3+M_4$) are expected to be within a predetermined range. In the preferred embodiment of the system with consideration of the field decay, the system's internal noise and the tolerances of component parameters, this range is established as ±15% when comparing ($M_1+M_4$) with ($M_2+M_3$), and as ±25% for the comparison between ($M_1+M_2$) and ($M_3+M_4$).

As has been explained above the link between the sums ($M_1+M_3$) and ($M_2+M_4$) can be very loose, but nevertheless, the verification of whether their ratios are within even such a wide range as ±75% can increase the noise immunity of the system significantly. Thus, three so called "window comparators" are employed to check whether the ratios of $$\frac{M_1+M_4}{M_2+M_3}, \frac{M_1+M_2}{M_3+M_4} \text{ and } \frac{M_1+M_3}{M_2+M_4}$$

are within the ranges of 15%, 25% and 75% respectively. The outputs of all these comparators are combined in a logic AND-manner so that the output (126) of the examiner (123) is in active state when the results of all comparisons are positive. The signal (126) is only a preliminary indication of the possible presence of a tag inside the protected gate. Once originated by checks on the frozen values $M_1$–$M_4$, the signal (126) will stay for the rest of the surveillance cycle. The signal (126) will then await for results of additional checks to be joined by them at the inputs of the logic AND-gate (143) in order to create an alarm-signal (32).

The next two tests are designed to verify whether the signal (126) is true or is a result of either a metal object or a deactivated tag in a strong field. These two tests are based upon the method, which has been disclosed previously in great detail. In the preferred embodiment of this method two comparators (127, 128) and two latches (129, 131) are used. The comparators (127, 128) both have at one of their inputs a signal (88) from the magnitude extractor (87). Their second inputs use references derived from the average level $M_{ave}$ of the "main" magnitudes $M_1$–$M_4$ as supplied by the static examiner (123). The latches (129, 131) are enabled by respective strobes (130, 132) to store the logic levels from the outputs of respective comparators (127, 128).

The strobe 130 is derived from command 114 during the second window cycle only. It starts after the build-up of the level $M_{(-)}$ at the output of the magnitude extractor (87) (during two successive windows $W_{(-)}$) has been completed. If at the time of the strobe 130 the level $M_{(-)}$ is lower at least by 20% than $M_{ave}$ then the output of the comparator 127 will be high and will be stored in the latch 129, appearing at one of the inputs of the AND-gate (143).

The strobe 132 is derived from command 115 also during the second window cycle only. This strobe follows the second of the windows $W_h$. The windows $W_h$ coincide with those parts of respective transmission periods wherein the interrogation field is made weaker by a predetermined factor. If by the end of the second window $W_h$ the accumulated magnitude $M_h$ is also smaller than $M_{ave}$ made weaker by a predetermined factor, then the logic "1" at the output of the comparator 128 will be latched in 131 by strobe 132 and will be applied to yet another input of the AND-gate 143.

The probability of false alarms due to external random noise, caused for example by brushes of electrical motors, is greatly reduced by checking the repeatability of the corresponding main magnitudes $M_1$–$M_4$ in both accumulation cycles. The repeatability test utilizes a four-channel analog multiplexer (133), a range comparator (135), an AND-gate (136) and a counter (138).

Four inputs of the multiplexer (133) are connected to the outputs of respective sample-and-hold units (118–121). The multiplexer (133) is controlled by commands 134 which are derived from commands 110–113 during the fourth window cycle. The commands 134 select the stored values $M_1$–$M_4$ to appear in sequence at the output of the multiplexer (133). Here the appearance of the stored levels $M_1$–$M_4$ coincides in time with the "live" levels $M_{1\text{-}2}$–$M_{4\text{-}2}$ as they emerge from the output

(88) of the magnitude extractor (87) during the second accumulation cycle.

One of the inputs of the comparator (135) is connected to the output of the multiplexer (133), the second input of the comparator (135) is connected to the output (88) of the magnitude extractor (87). Thus, the range comparator (135) checks whether the "live" values $M_{1-2}$–$M_{4-2}$ are repeating corresponding "frozen" values $M_1$–$M_4$ with a predetermined accuracy of, say, ±20%. The output of the comparator (135) is connected to one of two inputs of the AND-gate (136), to the second input of which four strobes (137) are applied. These strobes are derived from commands 110–113 during the fourth window cycle. Thus, when the comparator (135) establishes, four times in a row, the similarity between corresponding "live" ($M_{1-2}$–$M_{4-2}$) and "frozen" ($M_1$–$M_4$) magnitudes, then four pulses to that effect enter the clock input of the counter (138) and at its decoded output (139), corresponding to four counts, a logic "1" will appear and will be applied to yet another input of the AND-gate (143).

During the last test comparator (140) checks whether the average value $M_{ave}$ of the main magnitudes $M_1$–$M_4$ is actually higher (at least by 20% for example) than the level of the dynamic threshold (30). As has been explained earlier the threshold value is provided by pick-detector (124) which selects and stores the highest value among the noise magnitudes $M_{N1}$, $M_{N2}$ appearing in every accumulation cycle throughout the whole surveillance cycle. Therefore the peak detector (124) is connected to the output (88) of the magnitude extractor (87) via an analog switch (144), which is closed every time when the commands 116 and 117 controlling the switch (144) are applied to the inputs of the OR-gate (145). The peak detector (124) is cleared by command 125 from the controller (14) at the beginning of every surveillance cycle.

The threshold value (30) is considered to be mature at the end of the last command 117 (in the fourth window cycle), and only then the logic level at the output (141) of the comparator (140) can be trusted, considering the dynamic nature of the signal (30) at the output of the peak detector (124).

The comparator (140) supplies its output signal (141) to one of two yet remaining unused inputs of the AND-gate (143), and to the last of those inputs a strobe (142) is applied. The strobe (142) is originated in the controller (14) just following the rear edge of the last command (117) in the surveillance cycle. The meaning of the strobe (142) is "make a decision". The decision to set an alarm will be represented by a high level of the output (32) of the AND-gate (143), when all its inputs are high. The present invention is most effective when pulsing transmission of the interrogation field is used. Nevertheless, some aspects of the invention are applicable to systems with continuous transmission of the field. These aspects include but are not limited to the modification of the original tag signals, the use of synchronous detection and accumulations methods, the rejection of periodic noises within each time window and the periodic evaluation of noise during the gaps between windows wherein no tag signal can possibly exist.

It is understood that after the above explanation of the invention various modifications may readily occur to an expert in the art without departing from the scope of the present invention and that such modifications will be deemed to fall under the scope of protection of the claims.

I claim:

1. A method for detecting the presence of protected objects in a surveillance zone wherein an alternating electromagnetic interrogation field having a predetermined level of strength and a predetermined frequency is generated in said surveillance zone, wherein security tags comprising easily saturable magnetic materials are attached to the protected objects, said security tags when subjected to said alternating interrogation field being repeatedly saturated and producing original tag signals, wherein said original tag signals are received by receiving means, wherein signals received by said receiving means are processed during certain time intervals defined as time windows to determine whether any of said signals received by said receiving means is a tag signal in which case an alarm signal is produced, said method comprising the step of transforming said signals received by said receiving means into modified signals such that each of said original tag signals is transformed into a modified tag signal, said modified tag signal being an amplitude modulated AC-pulse with a predetermined carrier frequency and a predetermined envelope shape.

2. A method according to claim 1 wherein the transforming step is carried out by passing said signals received by said receiving means through a band-pass filter, the gain versus frequency characteristic of said band-pass filter having the shape of at least a central band of the density spectrum of the modified tag signal.

3. A method according to claim 1 wherein the signal processing is accomplished in surveillance cycles, each of the surveillance cycles comprising a plurality of said time windows which are further subdivided into a predetermined number of signal windows and a predetermined number of noise windows, said signal windows each being of predetermined duration, said signal windows each being positioned to include at least one modified tag signal when at least a predetermined number of modified tag signals is present, said predetermined number of modified tag signals corresponding to the number of signal windows in a given surveillance cycle, said noise windows each being of predetermined duration and being positioned not to include any of said predetermined number of modified tag signals.

4. A method according to claim 3 wherein the time windows of each of said surveillance cycles are grouped to constitute a predetermined number of window cycles, each window cycle comprising a predetermined number of said signal windows and a predetermined number of said noise windows, each of said signal and noise windows having predetermined starting and ending moments within each of the window cycles, said signal and noise windows being sequentially numbered starting from number one in each of the window cycles, wherein each window cycle in a given surveillance cycle comprises a predetermined time interval between the beginning of the window cycle and the moment at which the alternating interrogation field crosses its zero level for the first time after the beginning of the window cycle such that, in correspondingly numbered signal windows of respective window cycles, modified tag signals are equally phase-shifted.

5. A method according to claim 4 wherein said interrogation field is generated in transmission cycles, each of said transmission cycles comprising at least one transmission pulse and at least one pause, each transmission pulse comprising a number of periods of a predetermined frequency, each of said transmission cycles corresponding to a respective one of said predetermined number of window cycles in such a way that a transmission pulse in a transmission cycle coincides with all signal windows of the corresponding window cycle, wherein a predetermined time interval exists between the beginning of each said transmission cycle and its corresponding window cycle.

6. A method according to claim 4 further comprising the step of generating first and second periodic reference waves, each said reference wave starting with a fixed initial phase at the beginning of each of the window cycles, each said reference wave having a period equal to the period of the carrier frequency of the modified tag signals, said first and second reference waves having a phase difference of 90 degrees.

7. A method according to claim 6 further comprising the steps of first and second phase-sensitive detections of said modified signals, wherein the first phase-sensitive detection is carried out by multiplying said modified signals by (+1) and by (−1) in alternation during every half period of said first reference wave, and the second phase-sensitive detection is carried out by multiplying said modified signals by (+1) and by (−1) in alternation during every half period of said second reference wave, said first and second phase-sensitive detections producing first and second phase-sensitive detection signals respectively.

8. A method according to claim 7 wherein each of said surveillance cycles is subdivided into a predetermined number of accumulation cycles, each accumulation cycle comprising a predetermined number of said window cycles, and wherein said first and second phase-sensitive detection signals are integrated a predetermined number of times, each integration of a phase-sensitive detection signal occurring during correspondingly numbered time windows of respective window cycles in each accumulation cycle, such that at the end of each accumulation cycle each integration of said first and second phase-sensitive detection signals produces corresponding first and second accumulation signals in the form of DC-voltage levels.

9. A method according to claim 8 wherein said first and second accumulation signals are squared, the squares of the accmulation signals are added and the square root of the added squares of the accmulation signals is extracted, wherein at the end of a signal window of the last one of said window cycles in each accumulation cycle said square root represents the magnitude of a modified tag signal in said signal window, said magnitude being independent of an initial phase of said modified tag signal, and wherein at the end of a noise window of the last one of said window cycles in each accumulation cycle said square root represents the magnitude of noise in said noise window.

10. A method according to claim 9 further comprising the step of synchronous rejection of periodic noise, wherein the duration of any time window is made equal both to an even number of periods of periodic noise to be synchronously rejected and to an odd number of periods of said first and second reference waves, such that first and second accumulation signals resulting from said periodic noise, and therefore the magnitude of said periodic noise, become zero at the end of said any time window.

11. A method according to claim 9 wherein each accumulation cycle comprises at least one pair of window cycles having correspondingly numbered windows the start of each of which is delayed from the start of its respective window cycle by a predetermined period, the time difference between corresponding delays being equal to an odd number of half periods of the first and second reference waves, an interval between said correspondingly numbered windows being equal to an integer number of periods of a periodic noise to be synchronously rejected, such that first and second accumulation signals resulting from said periodic noise, and therefore the magnitude of said periodic noise, become zero at the end of the second of any two correspondingly numbered windows of said at least one pair of window cycles.

12. A method according to claim 9 wherein the magnitudes of noise in the noise windows of each of the surveillance cycles are combined in accordance with a predetermined algorithm to produce a DC-voltage level defined as a dynamic reference.

13. A method according to claim 12 wherein said dynamic reference is produced by deriving a maximal value of said magnitudes of noise in each of said surveillance cycles.

14. A method according to claim 12 wherein said signal windows in at least one of said window cycles of each of the surveillance cycles are further subdivided into a predetermined number of main windows and a predetermined number of auxiliary windows, said main windows coinciding with a period of time during which said interrogation field is transmitted at said predetermined level of strength.

15. A method according to claim 14 further comprising the step of averaging the magnitudes of signals in said main windows of at least one of the accumulation cycles in each of the surveillance cycles resulting in a value defined as an averaged magnitude.

16. A method according to claim 15 wherein during a first auxiliary window said predetermined level of strength of the interrogation field is decreased by a predetermined factor, said first auxiliary window being defined as a weaker field window, and wherein said surveillance zone is monitored by first and second receiving means, signals received by said first and second receiving means being summed during at least said main windows and the weaker field window of each of said window cycles, said signals of said first and second receiving means being subtracted one from the other during a second auxiliary window, said second auxiliary window not coinciding with the weaker field window, said second auxiliary window being defined as a subtraction window.

17. A method according to claim 16 wherein during at least one of the accumulation cycles a third check is made to determine whether a ratio of the magnitude of a signal in said subtraction window to said averaged magnitude is smaller than a predetermined value and whether a ratio of said averaged magnitude to the magnitude of a signal in said weaker field window is lower than a predetermined value, said third check indicates whether the signals in said main windows are caused by a security tag or by some other metal object.

18. A method according to claim 15 wherein a first check is made to determine whether said averaged magnitude is greater than said dynamic reference.

19. A method according to claim 15 wherein said magnitudes of signals in said main windows of at least one of the accumulation cycles are combined in accordance with a predetermined algorithm to produce a number of predetermined combinations of said magnitudes of signals in said main windows and wherein a second check is made to determine whether a predetermined number of ratios of said predetermined combinations of said magnitudes of signals in said main windows of said at least one of the accumulation cycles are within predetermined ranges.

20. A method according to claim 14 wherein a fourth check is conducted to determine whether magnitudes of signals in each of the correspondingly numbered main windows of each of the accumulation cycles is a surveillance cycle are of similar order having their ratios within predetermined limits.

21. A method according to claim 3 wherein said surveillance zone is formed between a first and a second transmitting antenna, such that during some surveillance cycles both said first and second transmitting antennae transmit their oscillatory fields simultaneously and in phase opposition, while during some other surveillance cycles only one of said antennae transmits.

22. A method according to claim 3 wherein during every surveillance cycle at least one check is made in order to decide whether to produce an alarm signal.

23. An electromagnetic security system for detecting the presence of protected objects in a surveillance zone, said security system comprising transmitting means including a transmitter and a transmitting antenna to generate and to transmit into said surveillance zone an alternating electromagnetic interrogation field having a predetermined level of strength and a predetermined frequency, security tags comprising easily saturable magnetic materials attached to the protected objects, said tags when subjected to said alternating interrogation field being repeatedly saturated and producing original tag signals, receiving means to receive said original tag signals, said receiving means including at least one receiving antenna, signal processing means, including decision making means and alarm producing means, to process output signals from said receiving means during certain time intervals defined as time windows in order to determine whether any of said output signals is a tag signal in which case an alarm signal is produced, and controller means to control the operation of said transmitting means and signal processing means, said signal processing means comprising synthesizer means for transforming each of the original tag signals from said receiving means into a modified tag signal which is an amplitude modulated AC-pulse with a predetermined carrier frequency and a predetermined envelope shape.

24. A system according to claim 23 wherein said synthesizer means is arranged as a band-pass filter the gain versus frequency characteristic of which has the shape of at least a central band of the density spectrum of the modified tag signal.

25. A system according to claim 23 wherein said transmitter comprises a power driver means, including first switching means, and a tuning capacitor connected to the transmitting antenna to form a resonance circuit, said first switching means being controlled by respective logic signals from said controller means to provide an operation of said transmitter in two modes, said power driver means charging said resonance circuit thereby initiating oscillations of the interrogation field at said predetermined level of strength in a first mode, and said power driver means discharging the resonance circuit thereby providing a predetermined degree of attenuation of the interrogation field strength in a second mode.

26. A system according to claim 23 wherein said controller means establishes an operation of said signal processing means in surveillance cycles, during each of said surveillance cycles the controller means generating a predetermined number of said time windows, each of said time windows being generated in the form of a logic signal appearing at a respective window output of said controller means, said time windows are further grouped in a predetermined number of consecutive window cycles, the time windows in each of said window cycles being subdivided into a predetermined number of signal windows and a predetermined number of noise windows, said signal windows each being of predetermined duration, said signal windows each being positioned to include at least one modified tag signal when at least a predetermined number of modified tag signals is present, said predetermined number of modified tag signals corresponding to the number of signal windows in a given surveillance cycle, said noise windows each being of predetermined duration and being positioned not to include any of said predetermined number of modified tag signals, each of said signal and noise windows having predetermined starting and ending moments within each of said window cycles, said signal and noise windows being sequentially numbered starting from number one in each of the window cycles, wherein each window cycle in a given surveillance cycle comprises a predetermined time interval between the beginning of the window cycle and the moment at which the alternating interrogation field crosses its zero level for the first time after the beginning of the window cycle such that, in correspondingly numbered signal windows of respective window cycles, modified tag signals are equally phase-shifted.

27. A system according to claim 26 wherein said controller means is arranged to establish an operation of said transmitting means in transmission cycles, each of said transmission cycles comprising at least one transmission pulse and at least one pause, each transmission pulse comprising a number of periods of a predetermined frequency, each of said transmission cycles corresponding to a respective one of said predetermined number of window cycles in such a way that a transmission pulse in a transmission cycle coincides with all signal windows of the corresponding window cycle, wherein a predetermined time interval exists between the beginning of each said transmission cycle and its corresponding window cycle.

28. A system according to claim 26 wherein said controller means generates first and second periodic reference waves, each said reference wave starting with a fixed initial phase at the beginning of each of said window cycles, each said reference wave having a period equal to the period of the carrier frequency of the modified tag signals, said first and second reference waves having a phase difference of 90 degrees.

29. A system according to claim 28 wherein said signal processing means includes first and second phase-sensitive detectors, each of said phase-sensitive detectors being provided with a signal input, a reference input and an output, said signal inputs of said first and second phase-sensitive detectors being connected to an output of said synthesizer means, the reference inputs of said first and second phase-sensitive detectors being connected to reference outputs of said controller means to be supplied by said first and second reference waves respectively, each of said phase-sensitive detectors being arranged in such a way that a signal from its signal input is transferred to its output with a phase change of 180 degrees every half period of a reference wave applied to the reference input of said phase-sensitive detector.

30. A system according to claim 29 wherein each of the surveillance cycles is subdivided by said controller means into a predetermined number of accumulation cycles, each accumulation cycle comprising a predetermined number of said window cycles, and wherein the signal processing means includes a predetermined number of pairs of first and second integration means producing at the end of each accumulation cycle a corresponding number of pairs of first and second accumulation signals, said integration means being provided with second switching means for resetting said integration means at the beginning of each accumulation cycle and for connecting inputs of all said first and all said second integration means to the outputs of said first and second phase-sensitive detectors respectively, said second switching means connecting said outputs of said phase-sensitive detectors to corresponding inputs of said integration means a predetermined number of times, each connection of said outputs of said phase-sensitive detectors to corresponding inputs of said integration means occurring during correspondingly numbered time windows of respective window cycles in each accumulation cycle.

31. A system according to claim 30 wherein during the last of said window cycles in each accumulation cycle the controller means generates shifted window signals in the form of logic signals, each of said shifted window signals corresponding to a respective time window of said last of said window cycles and starting after the termination of the respective time window, and wherein said shifted window signals do not overlap each other.

32. A system according to claim 31 wherein said signal processing means includes magnitude producing means having first and second inputs connected by a number of pairs of third switching means to respective outputs of said pairs of first and second integration means, said magnitude producing means producing a signal proportional to the square root of the sum of the squares of signals applied to said inputs of said magnitude producing means, each said pair of third switching means being controlled by at least one of the shifted window signals, so the signals at an output of said magnitude producing means are produced in synchronism with said shifted window signals, wherein at the end of a signal window of the last one of said window cycles in each accumulation cycle a signal at the output of said magnitude producing means represents the magnitude of a modified tag signal in said signal window, said magnitude being independent of an initial phase of said modified tag signal, and wherein at the end of a noise window of the last one of said window cycles in each accumulation cycle said signal at the output of said magnitude producing means represents the magnitude of noise in said noise window.

33. A system according to claim 32 wherein any time window of said window cycles produced by the controller means have a duration equal both to an even number of periods of a periodic noise to be synchronously rejected and to an odd number of periods of said first and second reference waves, such that first and second accumulation signals resulting from said periodic noise, and therefore the magnitude of said periodic noise, become zero at the end of said any time window.

34. A system according to claim 32 wherein each accumulation cycle produced by said controller means comprises at least one pair of window cycles having correspondingly numbered windows the start of each of which is delayed from the start of its respective window cycle by a predetermined period, the time difference between corresponding delays being equal to an odd number of half periods of the first and second reference waves, an interval between said correspondingly numbered windows being equal to an integer number of periods of a periodic noise to be synchronously rejected, such that first and second accumulation signals resulting from said periodic noise, and therefore the magnitude of said periodic noise, become zero at the end of the second of any two correspondingly numbered windows of said at least one pair of window cycles.

35. A system according to claim 32 wherein the signal processing means comprises reference producing means having an input connected to the output of said magnitude producing means during all shifted noise windows in every surveillance cycle, said reference producing means being arranged to produce in accordance with a predetermined algorithm a predetermined combination of said magnitudes of noise, said combination of said magnitudes of noise being defined as a dynamic reference.

36. A system according to claim 35 wherein said reference producing means includes a peak-detector, whereby said dynamic reference is produced by deriving a maximal value of said magnitudes of noise in every surveillance cycle.

37. A system according to claim 35 wherein said signal windows in at least one of the window cycles of each of the surveillance cycles are further subdivided by said controller means into a predetermined number of main windows and a predetermined number of auxiliary windows, said main windows coinciding with a period of time during which said interrogation field is transmitted at said predetermined level of strength.

38. A system according to claim 37 wherein the signal processing means includes memory means arranged to store the magnitude of signals in said main windows of at least one of the accumulation cycles during each of said surveillance cycles.

39. A system according to claim 38 wherein the signal processing means includes averager means arranged to produce an averaged magnitude by averaging said magnitudes of signals which are stored in said memory means.

40. A system according to claim 39 wherein during a first auxiliary window said controller means decreases said predetermined level of strength of the interrogation field by a predetermined factor, said first auxiliary window being defined as a weaker field window, wherein said surveillance zone is monitored by two receiving means and wherein an adder is used, said adder constructed as a universal summing and subtracting device with a mode control input connected to a respective output of said controller means, such that during at least said main windows and the weaker field window of each of said window cycles said adder sums output signals of said two receiving means, while during a second auxiliary window said adder substracts the output signals of one of said two receiving means from the output signals of the other of said two receiving means, said second auxiliary window not coinciding with the weaker field window, said second auxiliary window being defined as a subtraction window.

41. A system according to claim 40 wherein a third test unit includes third comparator means, inputs of said third comparator means being connected respectively to the output of said magnitude producing means and to an output of the averager means, the operation of said third comparator means being enabled by the controller means during said subtraction window and during said weaker field window, the third comparator means producing at an output of said third test unit a signal of a predetermined logic level when a ratio of the magnitude of a signal in said subtraction window to said averaged magnitude is lower than first predetermined value and when a ratio of said averaged magnitude to the magnitude of a signal in said weaker field window is lower than second predetermined value, the third test unit indicating whether the signals in said main windows are caused by a security tag or by some other metal object.

42. A system according to claim 39 wherein a first test unit is arranged as first comparator means, first and second inputs of which are connected respectively to an output of said averager means and to an output of said reference producing means, said first test unit having an output providing a signal with a predetermined logic level when said averaged magnitude is greater than said dynamic reference.

43. A system according to claim 38 wherein a second test unit comprises combination means and second comparator means, inputs of said combination means being connected to said memory means in order to produce at outputs of said combination means according to a predetermined algorithm a number of predetermined combinations of the magnitudes of signals stored in said memory means, the outputs of said combination means being connected to inputs of said second comparator means in such a manner that said second comparator means produces at an output of said second test unit a signal of a predetermined logic level when a predetermined number of ratios of said predetermined combinations of the magnitudes of signals stored in said memory means are within predetermined ranges.

44. A system according to claim 38 wherein a fourth test unit comprises fourth comparator means, inputs of said fourth comparator means being connected respectively to outputs of the memory means and to the output of said magnitude producing means, said fourth comparator means being enabled by shifted main window signals from the controller means to compare the magnitudes of signals in main windows stored in said memory means during one of the accumulation cycles with the magnitudes of signals in correspondingly numbered main windows of other accumulation cycles, said fourth comparator means producing at an output of said fourth test unit a signal with a predetermined logic level when each of the ratios of the signals compared by said fourth comparator means is within predetermined limits.

45. A system according to claim 26 wherein said transmitting means comprises two transmitters and two transmitting antennae forming between them said surveillance zone, said transmitters having resonance circuits energized by the controller means, in such a manner that during some surveillance cycles both transmitting antennae transmit their oscillatory fields simultaneously and in phase opposition, while during some other surveillance cycles only one of said two antennae transmits.

46. A system according to claim 23 wherein the decision making means is provided with an output and comprises one or more test units each having an output, a signal at the output of said decision making means being a predetermined logic function of signals at the outputs of one or more of said test units.

* * * * *